US009370787B2

(12) United States Patent
Yamauchi

(10) Patent No.: US 9,370,787 B2
(45) Date of Patent: Jun. 21, 2016

(54) ROTARY ATOMIZING HEAD TYPE COATING MACHINE

(71) Applicant: ABB K.K., Shibuya-ku (JP)

(72) Inventor: Kuniharu Yamauchi, Nagakute (JP)

(73) Assignee: ABB K.K., Tokyo (JP)

( * ) Notice: Subject to any disclaimer, the term of this patent is extended or adjusted under 35 U.S.C. 154(b) by 0 days.

(21) Appl. No.: 14/237,298

(22) PCT Filed: Mar. 11, 2013

(86) PCT No.: PCT/JP2013/056626

§ 371 (c)(1),
(2) Date: Feb. 5, 2014

(87) PCT Pub. No.: WO2013/161404

PCT Pub. Date: Oct. 31, 2013

(65) Prior Publication Data

US 2014/0151462 A1 Jun. 5, 2014

(30) Foreign Application Priority Data

Apr. 27, 2012 (JP) ..... 2012-103268

(51) Int. Cl.
*B05B 5/04* (2006.01)
*B05B 5/043* (2006.01)
(Continued)

(52) U.S. Cl.
CPC ..... *B05B 3/1035* (2013.01); *B05B 3/1057* (2013.01); *B05B 5/043* (2013.01); *B05B 5/0407* (2013.01); *B05B 15/02* (2013.01); *B05B 15/025* (2013.01)

(58) Field of Classification Search
CPC .. B05B 3/1021; B05B 3/1064; B05B 5/0407; B05B 5/0403; B05B 15/025; B05B 15/02; B05B 15/0225; B05B 15/0233
USPC ..... 239/104, 106, 112, 223, 224, 237, 240, 239/263, DIG. 14, 380
See application file for complete search history.

(56) References Cited

U.S. PATENT DOCUMENTS 5,676,756 A * 10/1997 Murate et al. ..... 118/629
5,813,608 A 9/1998 Yoshioka et al.
(Continued)

FOREIGN PATENT DOCUMENTS

JP 7 171483 7/1995
JP 8 112559 5/1996
(Continued)

OTHER PUBLICATIONS

International Search Report Issued May 21, 2013 in PCT/JP13/056626 Filed Mar. 11, 2013.

*Primary Examiner* — Arthur O Hall
*Assistant Examiner* — Christopher R Dandridge
(74) *Attorney, Agent, or Firm* — Oblon, McClelland, Maier & Neustadt, L.L.P.

(57) ABSTRACT

A feed tube is provided in a rotational shaft that is rotated by a motor. The feed tube includes a connecting member that includes a paint supplying port, a tube body including a base end connected to the connecting member and a front end that extends in the rotational shaft toward a rotary atomizing head, a positioning member provided in the front end of the tube body and including a tube positioning hole, and a paint tube including a base end connected to the paint supplying port of the connecting member and a front end inserted through the tube positioning hole of the positioning member. The paint tube is formed of a tubular body in an inside of which a paint passage is formed by using a resin material having water repellency.

9 Claims, 19 Drawing Sheets

(51) Int. Cl.
*B05B 15/02* (2006.01)
*B05B 3/10* (2006.01)

(56) References Cited

U.S. PATENT DOCUMENTS

| | | | | |
|---|---|---|---|---|
| 6,089,277 | A * | 7/2000 | Kodama et al. | 138/126 |
| 6,986,366 | B2 * | 1/2006 | Martin et al. | 138/98 |
| 2008/0277496 | A1 * | 11/2008 | Yasuda | B05B 3/1014 239/112 |
| 2009/0020635 | A1 * | 1/2009 | Yasuda | B05B 3/1064 239/703 |

FOREIGN PATENT DOCUMENTS

| | | | | |
|---|---|---|---|---|
| JP | 8 318179 | | 12/1996 | |
| JP | 9 998 | | 1/1997 | |
| JP | 2003 236414 | | 8/2003 | |
| JP | 2009 195767 | | 9/2009 | |
| JP | 2010 42360 | | 2/2010 | |
| WO | WO2011060889 | * | 5/2011 | B05B 5/04 |

* cited by examiner

ROTARY ATOMIZING HEAD TYPE COATING MACHINE

TECHNICAL FIELD

The present invention relates to a rotary atomizing head type coating machine suitable for use in a coating on a coating object, for example, an automobile, a household electrical product or the like.

BACKGROUND ART

In general, a rotary atomizing head type coating machine that is excellent in a coating efficiency and coating finish of paint is used for a coating in a case of applying paint on a vehicle body of an automobile, furniture, an electrical product and the like. This rotary atomizing head type coating machine is configured by a tubular housing an inner peripheral side of which forms part of a motor accommodating portion, an air-driven type motor that is accommodated in the motor accommodating portion of the housing, a hollow rotational shaft that is rotatably supported by the motor and a front end of which projects forward from the motor, a rotary atomizing head that is mounted to the front end of the rotational shaft and sprays paint supplied while rotating together with the rotational shaft, and a feed tube that extends through an inside of the rotational shaft from a rear side of the motor to the rotary atomizing head for supplying the paint to the rotary atomizing head (Patent Document 1).

PRIOR ART DOCUMENT

Patent Document

Patent Document 1: Japanese Patent Laid-Open No. 2010-42360 A

SUMMARY OF THE INVENTION

Incidentally, in a coating work using the rotary atomizing head type coating machine, there are some cases where a plurality of colors of paints are prepared and a single coating machine performs the coating while changing colors in use. In this case, it is required to wash out the previous color paint that remains in and is attached to an inside of a feed tube or the like in such a manner that the previous color paint, which has been applied until immediately before the next coating, is not mixed with the next color paint that will next be applied.

The feed tube is herein formed of a metallic material or a resin material high in strength, in consideration with letting a solvent paint flow therein and having a strength for straight extending toward a rotary atomizing head. However, in the wash work, as a surface roughness degree of a surface (inner surface or outer surface) of the feed tube is low (surface is rough), there are some cases where the paint attached to the surface is hard to peel off, and not only it takes time to wash it out but also it is difficult to completely wash it out.

Therefore, it is required to perform a grinding work on the surface of the feed tube for enhancing the surface roughness degree thereof (to smooth the surface). However, since a high-level technique and an expensive machine tool are required for grinding the surface of the elongated feed tube, manufacturing costs of the feed tube result in being very high. On the other hand, there are some cases where the surface of the feed tube is subjected to surface treatment of forming a film from which the paint is easy to peel off. Also in this case, the manufacturing cost likewise becomes high due to a remarkable rise in treatment costs, a problem in durability and the like.

Nowadays, there is a demand for performing a coating with two kinds of paints composed of a solvent paint and a water-base paint that are different in properties by a single painting machine, or for individually supplying a plurality of kinds of paints to the rotary atomizing head to perform a coating in order to simplify the wash work at color changing. It is required to extend the plural feed tubes to the rotary atomizing head for performing these coatings. In this case, as paint is ejected from one feed tube, a part of the paint enters into the other feed tube that has not ejected paint. As a result, when one time of the coating finishes, the other feed tubes that have not ejected the paint are all required to be washed out, thus resulting in an increase on the wash time and wash fluid. Further, in a case of performing a coating with a mixed paint (two-liquid paint) formed by mixing a main agent including pigment and the like with a curing agent by the rotary atomizing head, when the washing is insufficient as described above, there is a problem that the paint is cured.

The present invention is made in view of the above-mentioned problems of the conventional art, and an object of the present invention is to provide a rotary atomizing head type coating machine that can wash out paint attached on a surface of the feed tube for a short time and by a little wash fluid, and is provided with an inexpensive feed tube.

(1) A rotary atomizing head type coating machine according to the present invention comprises a motor of an air-driven type; a hollow rotational shaft that is rotatably supported by the motor and a front end of which projects forward from the motor; a rotary atomizing head that is mounted in the front end of the rotational shaft and sprays paint supplied thereto while rotating together with the rotational shaft; and a feed tube that extends through an inside of the rotational shaft from a rear side of the motor to the rotary atomizing head for supplying the paint to the rotary atomizing head.

In order to solve the above-mentioned problem, the configuration adopted by the present invention is characterized in that the feed tube comprises: a connecting member that is provided in the rear side of the motor and includes one or plural paint supplying ports connected to a paint supplying source; an elongated tube body that is formed of a hollow tubular body, and having a base end connected to the connecting member and a front end extended in the rotational shaft toward the rotary atomizing head; a positioning member that is provided in the front end of the tube body and includes one or plural tube positioning holes axially penetrating therein; and one or plural resin paint tubes that is provided to axially extend in the tube body, and having a base end connected to the paint supplying port of the connecting member and a front end inserted through the tube positioning hole of the positioning member, and the paint tube is formed as a tubular body in an inside of which a paint passage is formed by using a resin material having water repellency.

With this arrangement, the feed tube is provided with the paint tube formed of the resin material having the water repellency, and the paint can be supplied to the rotary atomizing head through the paint passage in the paint tube. Therefore, even if the paint is attached to the surface (inner surface and outer surface) of the paint tube having the water repellency, the attached paint can easily be washed out by only supplying a small amount of wash fluid. Further, in a case of providing the plural paint tubes, the paint that is ejected from one paint tube enters into the other paint tube that has not ejected paint. Also, in this case, the paint tube having the water repellency can easily wash out the entered paint.

On the other hand, the feed tube is provided with the connecting member and the positioning member, the base end of the paint tube is connected to the paint supplying port of the connecting member, and the front end of the paint tube is inserted through the tube positioning hole of the positioning member. Therefore, in a case where the paint tube is flexible, even if the paint tube has peculiar winding, the front end of the paint tube can be positioned in a predetermined position by the tube positioning hole of the positioning member, and an ejection direction of the paint can be defined toward the rotary atomizing head. Further, the tube body can cover and hide the fragile paint tube for protection.

Therefore, the previous color paint that is attached to the surface of the paint tube can certainly be washed out for a short time and by a small amount of wash fluid. On top of that, as a commercially available paint tube is used, the feed tube can be manufactured inexpensively.

(2) According to this invention, the connecting member is provided with a wash fluid supplying port that is connected to a wash fluid supplying source to be separated from the paint supplying port, the positioning member is provided with a wash fluid ejecting port that ejects wash fluid toward the rotary atomizing head, and the tube body is provided therein with a wash fluid passage through which the wash fluid flows between the wash fluid supplying port and the wash fluid ejecting port.

With this arrangement, the wash fluid that is supplied from the wash fluid supplying source can flow through the wash fluid supplying port of the connecting member, the wash fluid passage in the tube body, and the wash fluid ejecting port of the positioning member to be ejected from the wash fluid ejecting port toward the rotary atomizing head. Therefore, the paint that is attached to the periphery of the paint tube can be washed out by the wash fluid. Further, the paint that is attached to the rotary atomizing head can also be washed out.

(3) According to this invention, the wash fluid passage is formed as a wash fluid tube that axially extends in the tube body and establishes connection between the wash fluid supplying port and the wash fluid ejecting port.

With this arrangement, the wash fluid from the wash fluid supplying port of the connecting member can be supplied to the wash fluid ejecting port of the positioning member through the wash fluid passage in the wash fluid tube. In this case, a commercially available resin tube can be used as the wash fluid tube.

(4) According to this invention, the wash fluid passage is a flow space that is formed between an inner peripheral surface of the tube body and the paint tube, and in which the wash fluid flows.

With this arrangement, the wash fluid from the wash fluid supplying port of the connecting member can be supplied to the wash fluid ejecting port of the positioning member through the flow space between the inner peripheral surface of the tube body and the paint tube. In this case, since it is not required to separately provide a tube and the like, assembly workability can be improved by reducing the number of components.

(5) According to this invention, the tube positioning hole of the positioning member is provided with a plurality of projecting portions that support the paint tube by making top parts of the projecting portions projecting to an inner diameter side in contact with an outer peripheral surface of the paint tube.

With this arrangement, the front end of the paint tube can be positioned by inserting the front end of the paint tube into the tube positioning hole of the positioning member. In this case, the tube positioning hole is provided with the plurality of projections the top parts of which project to the inner diameter side and get in contact with the outer peripheral surface of the paint tube at this time. Therefore, the paint tube can smoothly be inserted into the tube positioning hole by reducing a contact area between the positioning member and the paint tube to reduce the friction resistance.

(6) According to this invention, the tube positioning hole of the positioning member is provided with a plurality of projecting portions that support the paint tube by making top parts of the projecting portions projecting to an inner diameter side in contact with an outer peripheral surface of the paint tube, and gaps that are provided between an inner peripheral surface of the tube positioning hole and the outer peripheral surface of the paint tube by the respective projecting portions are used as the wash fluid ejecting ports.

With this arrangement, the front end of the paint tube can be positioned by inserting the front end of the paint tube into the tube positioning hole of the positioning member. The tube positioning hole is provided with the plurality of projecting portions the top parts of which project to the inner diameter side and get in contact with the outer peripheral surface of the paint tube at this time. Therefore, the paint tube can smoothly be inserted into the tube positioning hole by reducing a contact area between the positioning member and the paint tube to reduce the friction resistance.

Further, the gaps provided between the inner peripheral surface of the tube positioning hole and the outer peripheral surface of the paint tube by the respective projecting portions can be used as the wash fluid ejecting ports. Therefore, the wash fluid can be supplied directly to the paint that is attached to the outer peripheral of the paint tube at a front end side to enhance the washing efficiency.

(7) According to this invention, the positioning member is provided with a concave curved surface portion in a concave curved shape that is formed in a front end position facing the rotary atomizing head, and the tube positioning hole is opened to the concave curved surface portion.

With this arrangement, the positioning member is provided with the concave curved surface portion in a concave curved shape that is formed in the front end position facing the rotary atomizing head. Therefore, when the wash fluid is ejected from the wash fluid ejecting port, the wash fluid can be made to flow by the concave curved surface portion. As a result, the paint that is attached to the front end of the positioning member can efficiently be washed out.

(8) According to this invention, the tube body is provided therein with an intermediate holding member that holds a halfway section of the paint tube in the length direction.

With this arrangement, the intermediate holding member that is provided in the tube body can hold the halfway section of the paint tube in the length direction. Therefore, it is possible to put even the flexible paint tube or the paint tube having peculiar winding through the tube body straight.

(9) According to this invention, the tube body is provided therein with a wash fluid tube, and having an axially extended base end side connected to the connecting member, and a front end side connected to the intermediate holding member, and the wash fluid tube is provided therein with a wash fluid passage in which the wash fluid supplied from a wash fluid supplying source flows.

With this arrangement, the axial base end side of the wash fluid tube is connected to the connecting member, the front end side thereof is connected to the intermediate holding member, wherein the wash fluid tube and the connecting member are provided in the tube body. Therefore, the wash fluid supplied from the wash fluid supplying source can be supplied toward the rotary atomizing head through the wash fluid passage in the wash fluid tube.

Here, a plurality of the paint tubes may be arranged in parallel in the tube body, and a plurality of the paint supplying ports of the connecting member and a plurality of the tube positioning holes of the positioning member may be arranged in parallel to correspond to an arrangement of the respective paint tubes.

In the configuration that the plurality of the paint tubes are thus arranged in parallel in the tube body, for example, two kinds of paints comprising a solvent paint and a water-base paint, which are different in properties, can be used for coating. In addition, the plurality of the paints can be used for coating by being individually supplied to the rotary atomizing head. Further, a main agent including pigment and the like, and a curing agent can be ejected individually from the plurality of the paint tubes, and the main agent and the curing agent can be mixed by the rotary atomizing head for coating.

On the other hand, a triple tubular structure may be adopted, in which the connecting member includes two pieces of the paint supplying ports and one piece of the wash fluid supplying port, and the paint tube is formed of an inner tube and an outer tube that are concentrically arranged, wherein a first paint passage of the paint passages is formed in the inner tube, a second paint passage thereof is formed in a circular space between the inner tube and the outer tube, and a circular space between the outer tube and the tube body is formed as a circular passage in which the wash fluid flows. In this configuration, the first paint passage is connected to one of the respective paint supplying ports, the second paint passage is connected to the other paint supplying port, and the circular passage is connected to the wash fluid supplying port, wherein the tube positioning hole of the positioning member can support the outer tube in a positioning state.

With this arrangement, two kinds of the paints comprising a solvent paint and a water-base paint, which are different in properties, can be used for coating by using the triple tubular structure. In addition, the main agent and the curing agent can be mixed by the rotary atomizing head for coating.

Further, the paint tube may be provided as a single tube in the tube body, wherein an inside of the paint tube is formed as the paint passage, and a space between the outer peripheral surface of the paint tube and the inner peripheral surface of the tube body is formed as the wash fluid passage in which the wash fluid flows.

Therefore, by only providing the single paint tube in the tube through hole of the tube body, the paint passage and the wash fluid passage can be formed to easily form the feed tube of a general rotary atomizing head type coating machine.

MODE FOR CARRYING OUT THE INVENTION

Hereinafter, a rotary atomizing head type coating machine according to an embodiment of the present invention will be in detail explained with reference to the accompanying drawings. Here, the rotary atomizing head type coating machine includes an electrostatic coating machine for coating with an application of a high voltage and a non-electrostatic coating machine for coating without an application of a high voltage. In the embodiment that will be described from now, an explanation will be made by citing an example of an electrostatic coating machine that directly applies a high voltage to a solvent paint.

FIG. 1 to FIG. 15 show a first embodiment of a rotary atomizing head type coating machine in the present invention.

Figure 1:
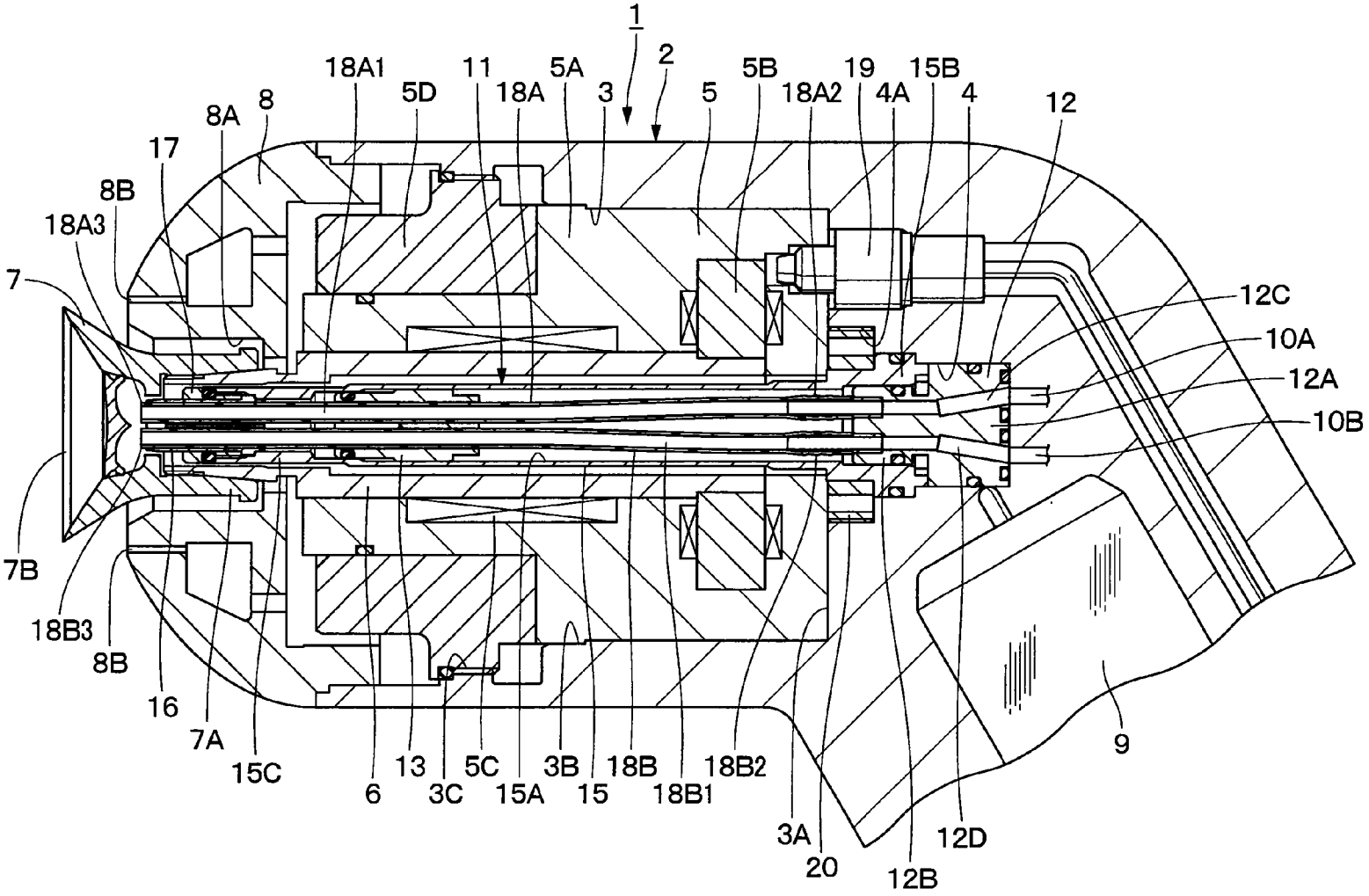
FIG. 1 is a longitudinal cross section showing a rotary atomizing head type coating machine provided with a double-type feed tube according to a first embodiment in the present invention.

In FIG. 1, designated at 1 is a rotary atomizing head type coating machine according to the first embodiment. The rotary atomizing head type coating machine 1 is formed as a direct-charged electrostatic coating machine that directly applies a high voltage to the paint by a high voltage generator 9 to be described later. The rotary atomizing head type coating machine 1 is mounted to a front end of an arm (not shown) in a coating robot, a reciprocator or the like, for example. The rotary atomizing head type coating machine 1 is configured to include a housing 2, an air motor 5, a rotary atomizing head 7 and a feed tube 11.

Denoted at 2 is the housing of the rotary atomizing head type coating machine 1. A bottomed motor accommodating portion 3 is provided on an inner peripheral side of the housing 2 to be opened to an axial front side. The motor accommodating portion 3 comprises a bottom face portion 3A that is positioned in the depth, and a stepped inner peripheral face portion 3B, and a female screw portion 3C is provided to be screwed at an open side (closer to a front side) of the inner peripheral face portion 3B. The air motor 5 is accommodated in the motor accommodating portion 3.

A connecting member accommodating portion 4 is formed to be recessed in the housing 2 in such a manner as to be positioned in the center of the bottom face portion 3A in the motor accommodating portion 3 and form a concentric circle with the motor accommodating portion 3. A connecting member 12 to be described later is fitted in the connecting member accommodating portion 4, which is formed as a stepped bottomed hole that is opened to the bottom face portion 3A. Further, a female screw portion 4A is provided to be screwed at an open side of the connecting member accommodating portion 4.

The housing 2 is herein formed by using a resin material having insulating properties. Therefore, the housing 2 establishes insulation to the rotary atomizing head 7 charged with a high voltage by the high voltage generator 9 and the feed tube 11, which will be described later, against the arm of the coating robot, which thus prevents a high voltage to be applied to the paint from leaking to the earth side. Further, the housing 2 is provided with a trigger valve, a front end washing valve and the like (none of them are shown).

The air motor 5 is provided in the housing 2, and the air motor 5 rotates a rotational shaft 6 and the rotary atomizing head 7 to be described later at a high speed of, for example, 3000 to 150000 rpm by using compressed air as a power source. The air motor 5 is formed of a stepped tubular motor case 5A that is accommodated in the motor accommodating portion 3 of the housing 2, a turbine 5B that is rotatably accommodated closer to a rear side of the motor case 5A, and a static bearing 5C that rotatably supports the rotational shaft 6.

The air motor 5 is fixed in the motor accommodating portion 3 by a circular fixing member 5D screwed into the female screw portion 3C at the open side in a state of being inserted in the motor accommodating portion 3 of the housing 2. Thus, the air motor 5 that is fixed in the motor accommodating portion 3 can rotatably support the rotational shaft 6 by supplying the compressed air to the static bearing 5C or the like. In this state, when the compressed air is supplied to the turbine 5B, the air motor 5 drives and rotates the rotary atomizing head 7 together with the rotational shaft 6 in a high speed.

Figure 2:
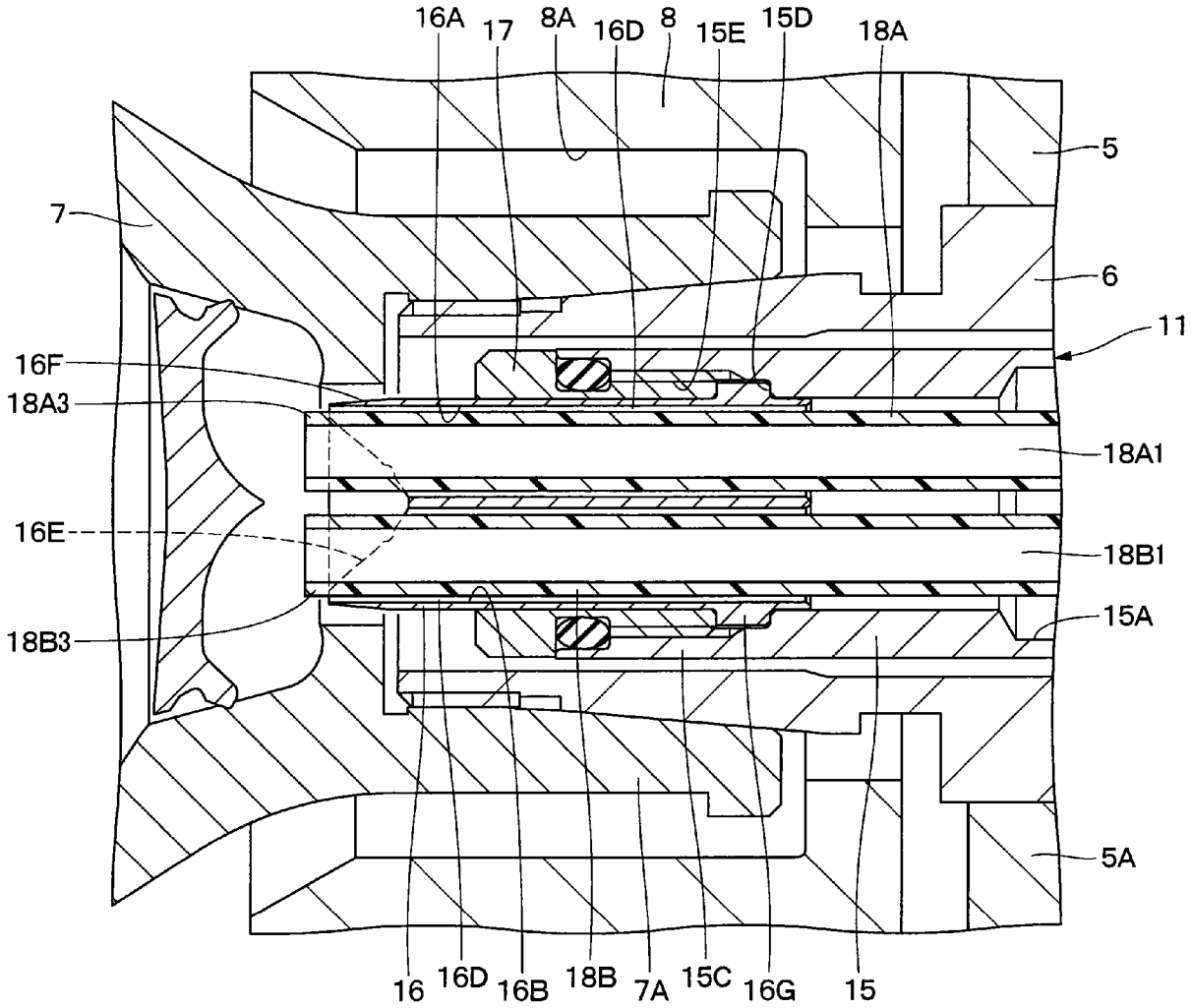
FIG. 2 is a partially enlarged longitudinal cross section showing a part of a rotational shaft, a rotary atomizing head, a positioning member, paint tubes and the like in FIG. 1.

The rotational shaft 6 is formed of a hollow body that is provided in the air motor 5, and is rotatably supported at a center position of the motor case 5A by the static bearing 5C. The base end of the rotational shaft 6 is mounted to be integral with the turbine 5B in an axis center position, and as shown in FIG. 2, a front end thereof projects forward from the motor case 5A. A mounting portion 7A of the rotary atomizing head 7 is mounted to the front end of the rotational shaft 6 that is a projecting end thereof.

Here, each of the motor case 5A of the air motor 5 and the rotational shaft 6 that are described above is formed by using a metallic material having electrical conductivity, such as an aluminum alloy, for example. On the other hand, the high voltage generator 9 makes electrical contact with the connecting member 12 to be described later. Thereby, the high voltage generator 9 can be connected electrically to the rotary atomizing head 7 through the motor case 5A and the rotational shaft 6, and can apply a high voltage to the paint that is provided toward the rotary atomizing head 7.

The rotary atomizing head 7 is mounted to the front end of the rotational shaft 6 in the air motor 5, and is formed in a bell shape or in a cup shape, for example. Specifically, the rotary atomizing head 7 has a base end that is formed as the tubular mounting portion 7A and a front end that is widened to be formed as a paint spray portion 7B. When the paint is supplied from the feed tube 11 to be described later to the rotary atomizing head 7 in a state of the rotary atomizing head 7 being rotated in a high speed by the air motor 5, the rotary atomizing head 7 sprays the paint as countless paint particles atomized by a centrifugal force from the paint spray portion 7B.

A shaping air ring 8 is provided at a front side of the housing 2, and is formed as a tubular body. The shaping air ring 8 is mounted at an open side of the motor accommodating portion 3 to be coaxial therewith, and the mounting portion 7A of the rotary atomizing head 7 and an atomizing head accommodating hole 8A for inserting the rotational shaft 6 are formed in the axis center position. Many pieces of air ejecting holes 8B (only two pieces are shown) open side by side in the circumferential direction in a front portion of the shaping air ring 8 to surround the rotary atomizing head 7. These air ejecting holes 8B are connected to an air pressure source through shaping air passages and pipe arrangements (none of them are shown).

The shaping air ring 8 ejects compressed air supplied from the air pressure source as shaping air from each air ejecting hole 8B. As a result, the shaping air adjusts a spraying pattern of the paint sprayed from the rotary atomizing head 7 to become a desired spraying pattern.

The high voltage generator 9 is provided in the housing 2. The high voltage generator 9 is configured with a Cockcroft circuit, for example, and boosts an electrical voltage supplied from a power source device (not shown) to −60 to −120 kV. An output side of the high voltage generator 9 is connected electrically to the connecting member 12 of the feed tube 11, for example, and therefore the high voltage generator 9 applies a high voltage to a solvent paint supplied toward the rotary atomizing head 7 for direct charging.

A first paint supplying passage 10A and a second paint supplying passage 10B are provided in the housing 2 in parallel with each other. The paint supplying passages 10A and 10B are respectively connected to paint sources (not shown) having different properties. For example, a solvent paint is supplied to the first paint supplying passage 10A, and a water-based paint is supplied to the second paint supplying passage 10B. The first paint supplying passage 10A is connected to a first paint supplying port 12C that is provided in the connecting member 12 in the feed tube 11 to be described later. The second paint supplying passage 10B is connected to a second paint supplying port 12D of the connecting member 12. On the other hand, a wash fluid supplying passage (not shown) is provided in the housing 2 in a position different from each of the paint supplying passages 10A and 10B. The wash fluid supplying passage is connected to a wash fluid supplying port 12E of the connecting member 12.

Next, an explanation will in detail be made of the configuration of the feed tube 11 according to the first embodiment with reference to FIG. 3 to FIG. 15. In the first embodiment, the feed tube 11 of a double type where two paint tubes 18A and 18B are arranged in parallel in the tube body 15 will be explained as an example.

Figure 3:
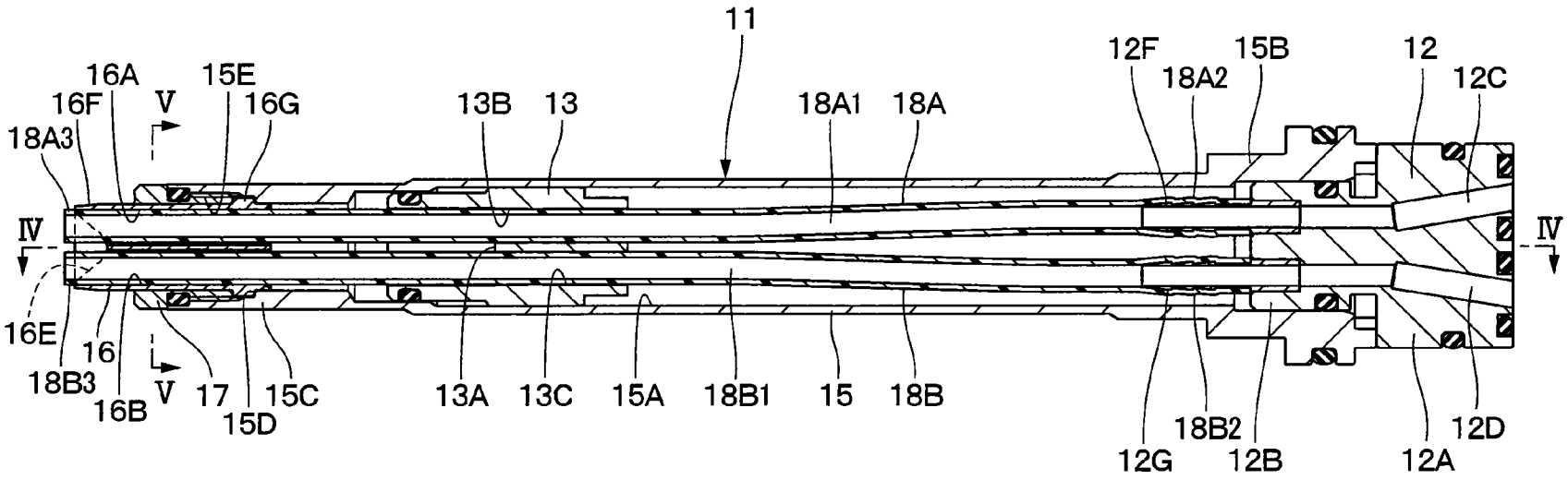
FIG. 3 is a longitudinal cross section showing the feed tube in FIG. 1 in an enlarged manner.
Figure 4:
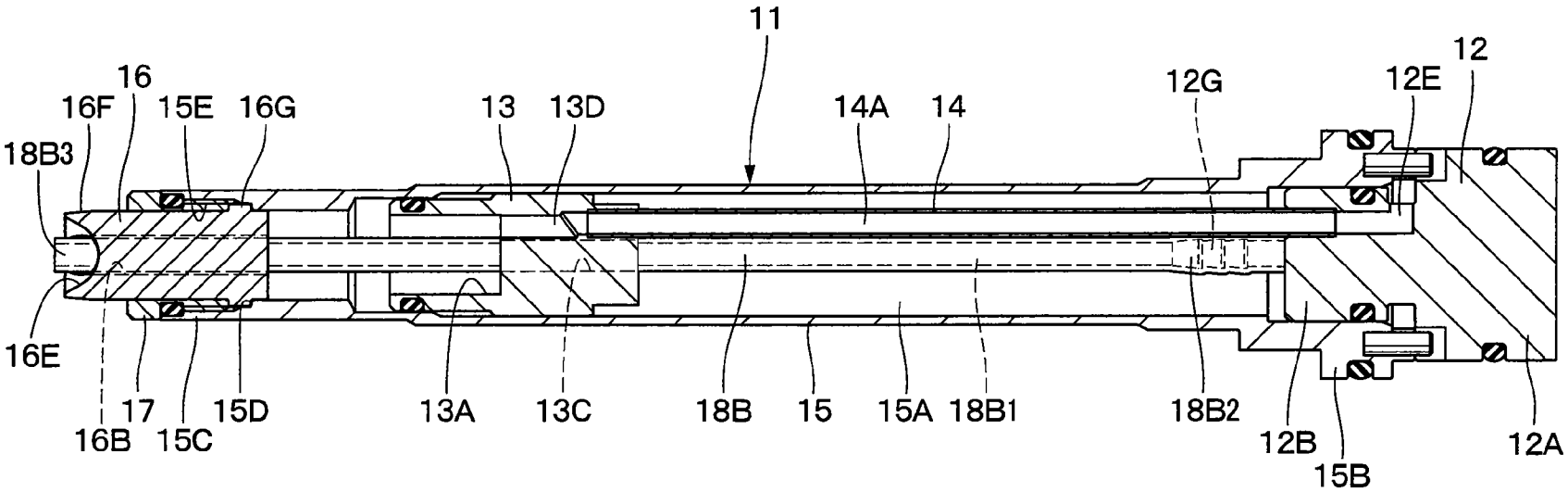
FIG. 4 is a longitudinal cross section showing the feed tube as viewed in the direction of arrows IV-IV in FIG. 3.
Figure 5:
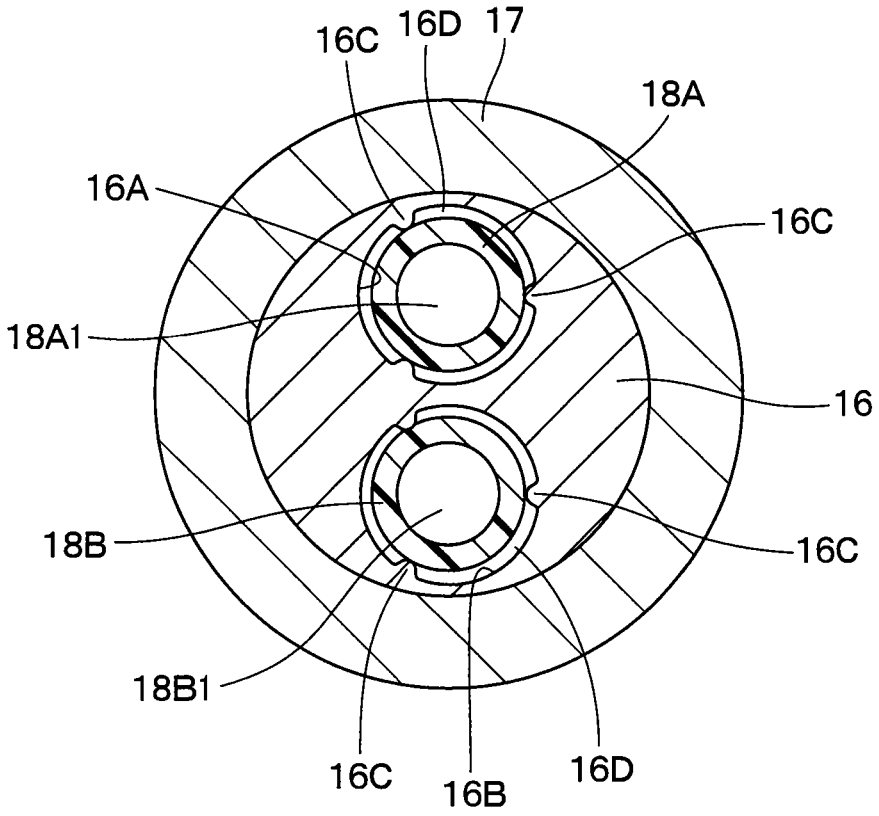
FIG. 5 is an enlarged transverse cross section of the tube body, the positioning member, and the paint tube as viewed in the direction of arrows V-V in FIG. 3.

Designated at 11 is the feed tube that is provided to be inserted through the rotational shaft 6. The feed tube 11 supplies paint to the rotary atomizing head 7, and extends to the rotary atomizing head 7 through the rotational shaft 6 from the connecting member accommodating portion 4 of the housing 2. The feed tube 11 supplies paints having different properties (kinds), for example, two kinds of paints composed of a solvent paint and a water-based paint as needed. As shown in FIG. 3 and FIG. 4, the feed tube 11 is configured with the connecting member 12, the intermediate holding member 13, the wash fluid tube 14, the tube body 15, the positioning member 16, and the paint tubes 18A and 18B, which will be described later.

The connecting member 12 is provided in the connecting member accommodating portion 4 of the housing 2, and the connecting member 12 is formed as a stepped columnar body of a rear large diameter portion 12A and a front small diameter portion 12B. The connecting member 12 is provided with the first paint supplying port 12C and the second paint supplying port 12D axially extending across the large diameter portion 12A and the small diameter portion 12B, and the wash fluid supplying port 12E provided to be separated from the respective paint supplying ports 12C and 12D (refer to FIG. 4). An upstream end (rear end portion) of the first paint supplying port 12C is connected to the first paint supplying passage 10A of the housing 2. On the other hand, an upstream end of the second paint supplying port 12D is connected to the second paint supplying passage 10B of the housing 2. An upstream end of the wash fluid supplying port 12E is connected to the wash fluid supplying passage of the housing 2.

Figure 6:
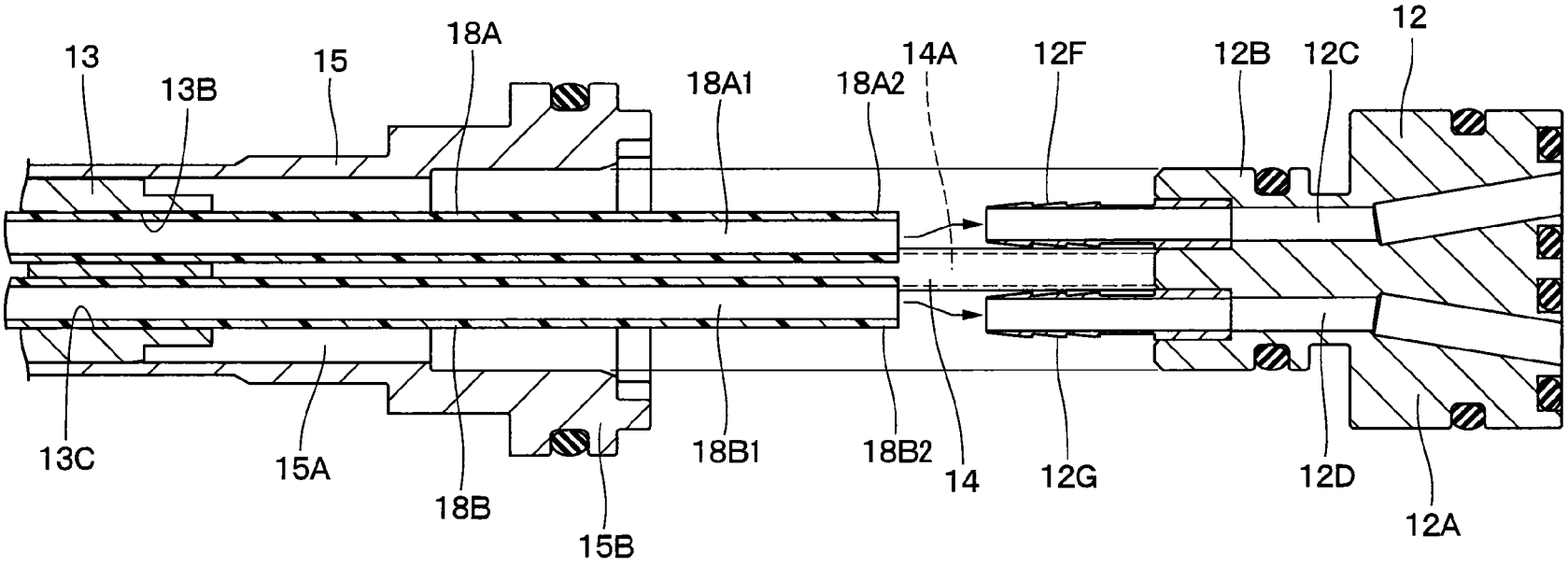
FIG. 6 is a partially enlarged, exploded longitudinal cross section showing the connecting member, the tube body, and the paint tube in an exploded state.
Figure 8:
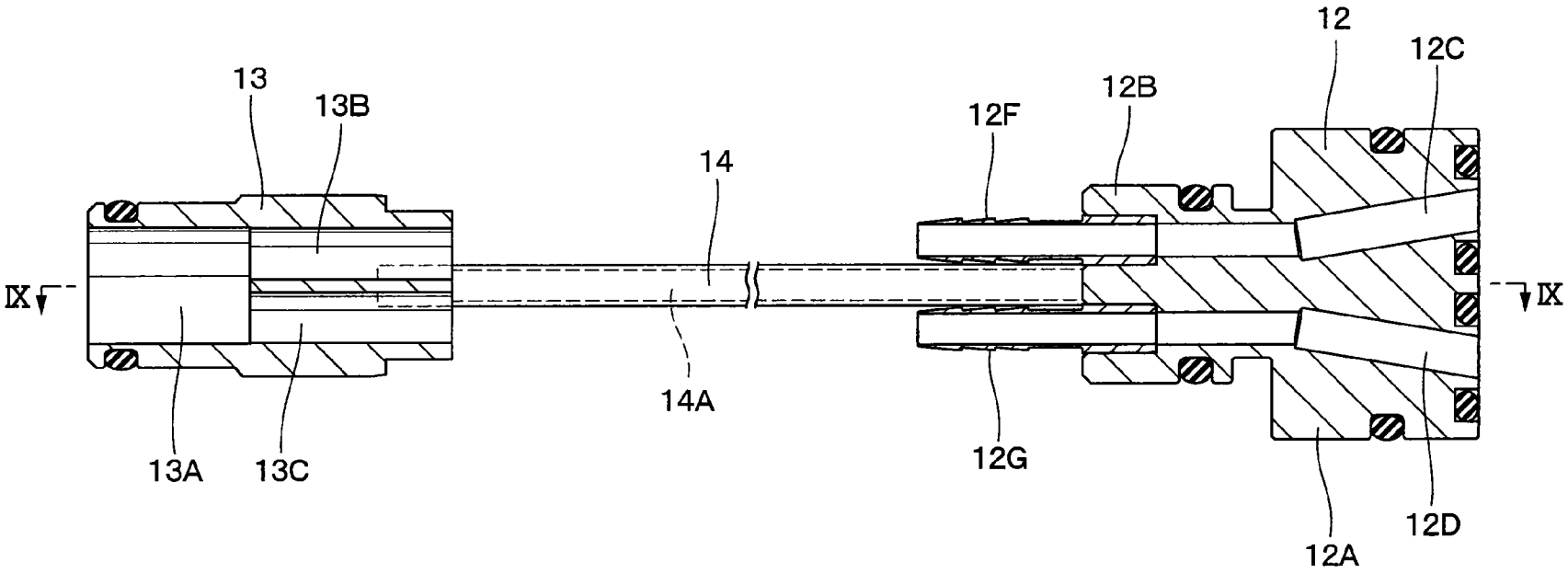
FIG. 8 is an enlarged longitudinal cross section showing the connecting member, the intermediate holding member and the wash fluid tube in an assembled state.
Figure 9:
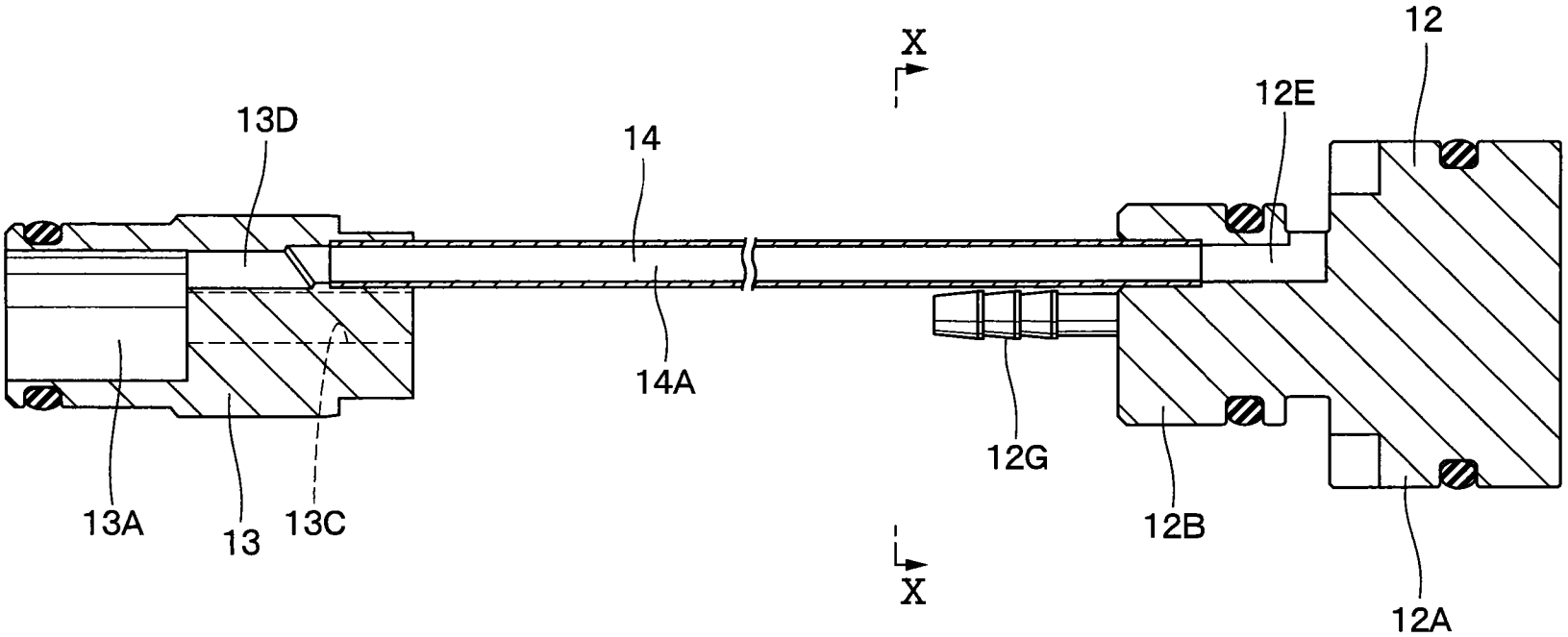
FIG. 9 is a longitudinal cross section showing the connecting member, the intermediate holding member and the wash fluid tube as viewed in the direction of arrows IX-IX in FIG. 8.
Figure 10:
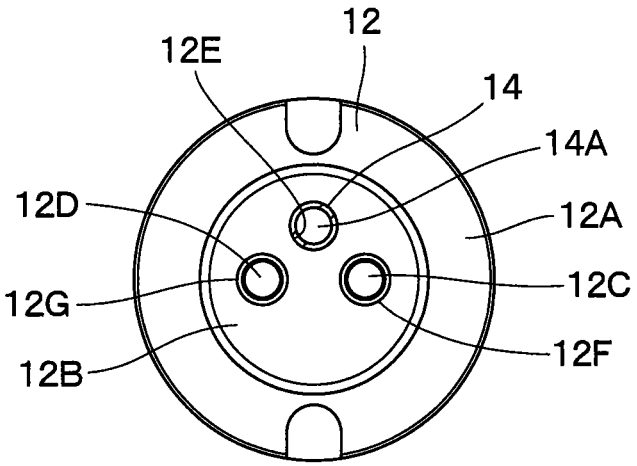
FIG. 10 is a transverse cross section showing the connecting member and the wash fluid tube as viewed in the direction of arrows X-X in FIG. 9.

As shown in FIG. 6 and FIG. 8, the connecting member 12 is provided with two tube joints 12F and 12G in a state of extending from a front end surface of the small diameter portion 12B. Each of the tube joints 12F and 12G is arranged in a symmetrical position about an axis line of the feed tube 11. The tube joints 12F and 12G are connected to the paint tubes 18A and 18B to be described later, a plurality of stepped sections are formed on an outer periphery of each of the tube joints 12F and 12G in a front end side in such a manner that the paint tubes 18A and 18B fitted on the outer peripheries thereof do not easily come away. For example, the tube joint 12F is connected to the downstream end (front end portion) of the first paint supplying port 12C, and the tube joint 12G is connected to the downstream end of the second paint supplying port 12D. Further, as shown in FIG. 9, a base end of the wash fluid tube 14 to be described later is connected to the small diameter portion 12B of the connecting member 12 to be communicated with the downstream end of the wash fluid supplying port 12E.

The intermediate holding member 13 is provided in the tube body 15 to be described later, and holds the halfway section of each of the paint tubes 18A and 18B to be described later in the length direction in a predetermined position by being arranged in a tube through hole 15A in the tube body 15. The intermediate holding member 13 is formed as a columnar body that is inserted into the tube through hole 15A, and a bottomed hole portion 13A is formed in a front side thereof.

As shown in FIG. 8, the intermediate holding member 13 is provided therein with two holding holes 13B and 13C that are arranged in parallel in symmetrical positions about an axis line to correspond to the respective tube joints 12F and 12G of the connecting member 12. When the paint tubes 18A and 18B are respectively inserted into the holding holes 13B and 13C, the halfway section of each of the paint tubes 18A and 18B in the length direction can be held to a predetermined position. Further, a wash fluid flow out passage 13D (refer to FIG. 9) is formed in the intermediate holding member 13 to be positioned between the respective holding holes 13B and 13C. The upstream end of the wash fluid flow out passage 13D opens to a position coaxial with the downstream end of the wash fluid supplying port 12E of the connecting member 12. On the other hand, the downstream end of the wash fluid flow out passage 13D opens to the bottom surface of the hole portion 13A.

The wash fluid tube 14 is provided between the connecting member 12 and the intermediate holding member 13 to axially extend in the tube body 15. Therefore, the wash fluid tube 14 has a length dimension equal to that between the connecting member 12 and the intermediate holding member 13. The wash fluid tube 14 is formed as a tubular body having strength, for example, an elongated, metallic tubular body. A base end of the wash fluid tube 14 that is the upstream end thereof is connected to the wash fluid supplying port 12E of the connecting member 12, and a front end thereof that is the downstream end thereof is connected to the wash fluid flow out passage 13D of the intermediate holding member 13.

An inside of the wash fluid tube 14 forms a wash fluid passage 14A. The wash fluid passage 14A connects the wash fluid supplying port 12E to the wash fluid flow out passage 13D of the intermediate holding member 13, thus making it possible to cause the wash fluid to flow therein. Here, the wash fluid passage 14A connects the wash fluid supplying port 12E of the connecting member 12 and a wash fluid ejecting port 16D of a positioning member 16 to be described later through the tube through hole 15A of the tube body 15. Therefore, the wash fluid supplied from the wash fluid supplying port 12E of the connecting member 12 can be ejected from the wash fluid ejecting port 16D of the positioning member 16 through the wash fluid passage 14A of the wash fluid tube 14, the bottomed hole portion 13A of the intermediate holding member 13, and the tube through hole 15A of the tube body 15.

The wash fluid tube 14 can arrange the connecting member 12 and the intermediate holding member 13 to have a predetermined interval dimension, and besides, can be used as a part of a flow route at the time of causing the wash fluid to flow. Thereby, it is possible to reduce the number of components for forming part of the feed tube 11.

Figure 11:
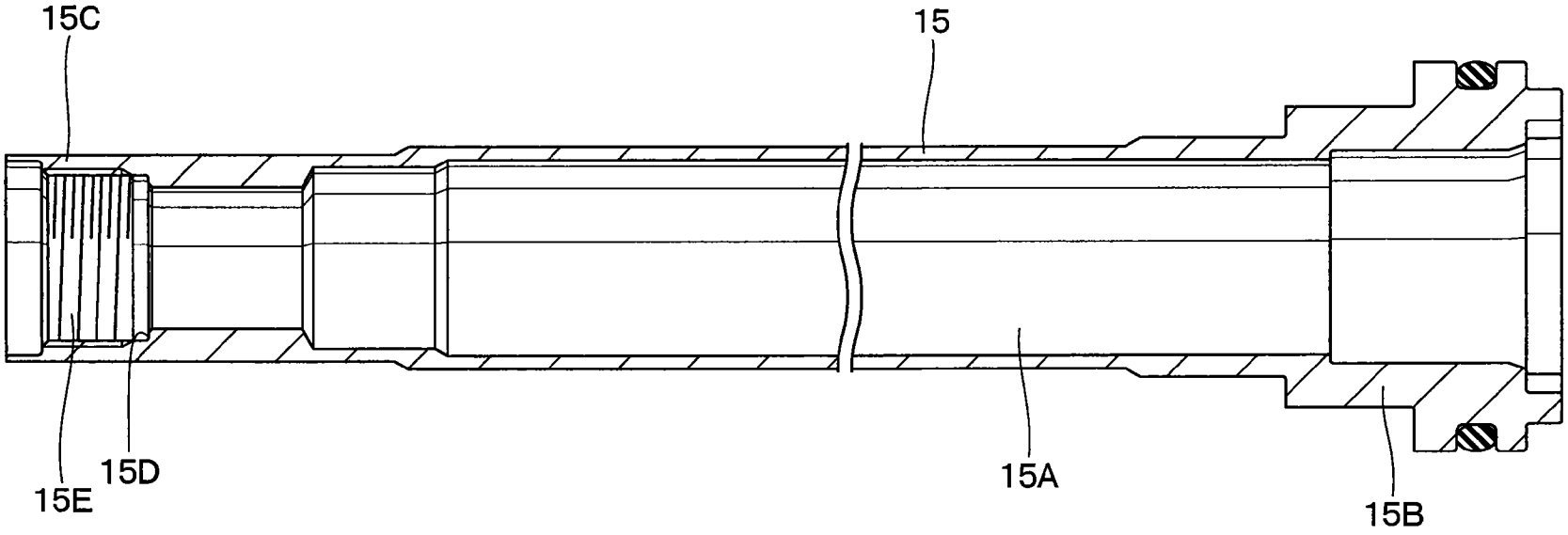
FIG. 11 is a longitudinal cross section showing the tube body as a single unit in an enlarged state.

The tube body 15 is formed as a hollow tubular body that extends toward the rotary atomizing head 7 in the rotational shaft 6. As shown in FIG. 11, the tube body 15 comprises a hollow tubular body as the tube through hole 15A provided at an inner peripheral side, and a base end 15B thereof increases in diameter step by step and is fitted on an outer periphery of the small diameter portion 12B of the connecting member 12 for connection. On the other hand, the front end 15C of the tube body 15 is provided with a stepped portion 15D that is formed by increasing an inner peripheral surface thereof in diameter, and a part thereof ahead of the stepped portion 15D forms a female screw portion 15E. A fixing tubular body 17 for fixing the positioning member 16 to be described later is screwed into the female screw portion 15E.

Figure 12:
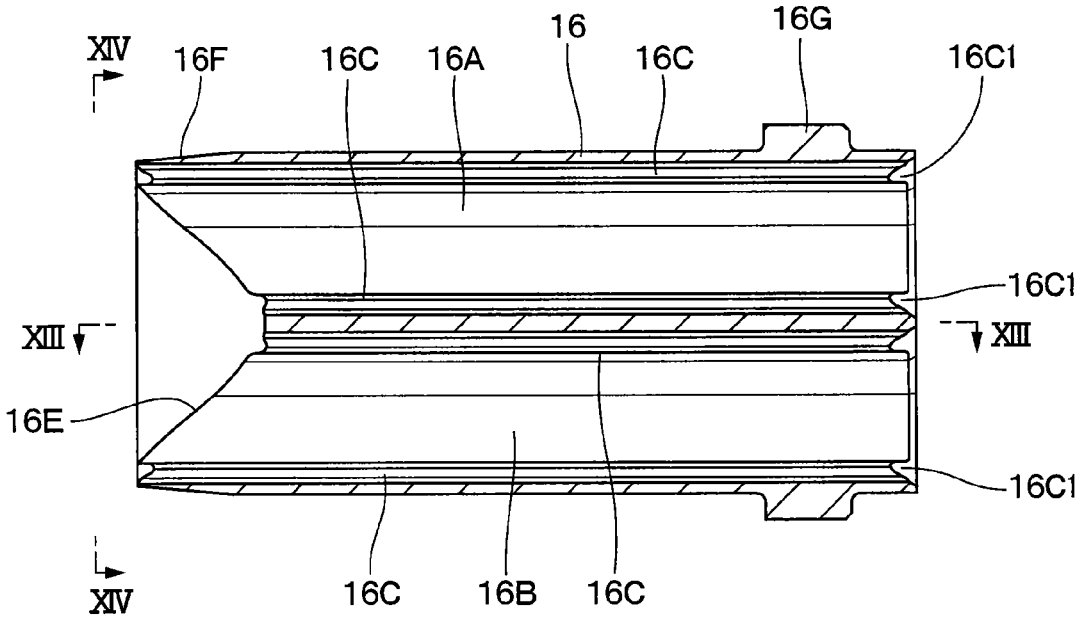
FIG. 12 is a longitudinal cross section showing the positioning member as a single unit in an enlarged state.
Figure 13:
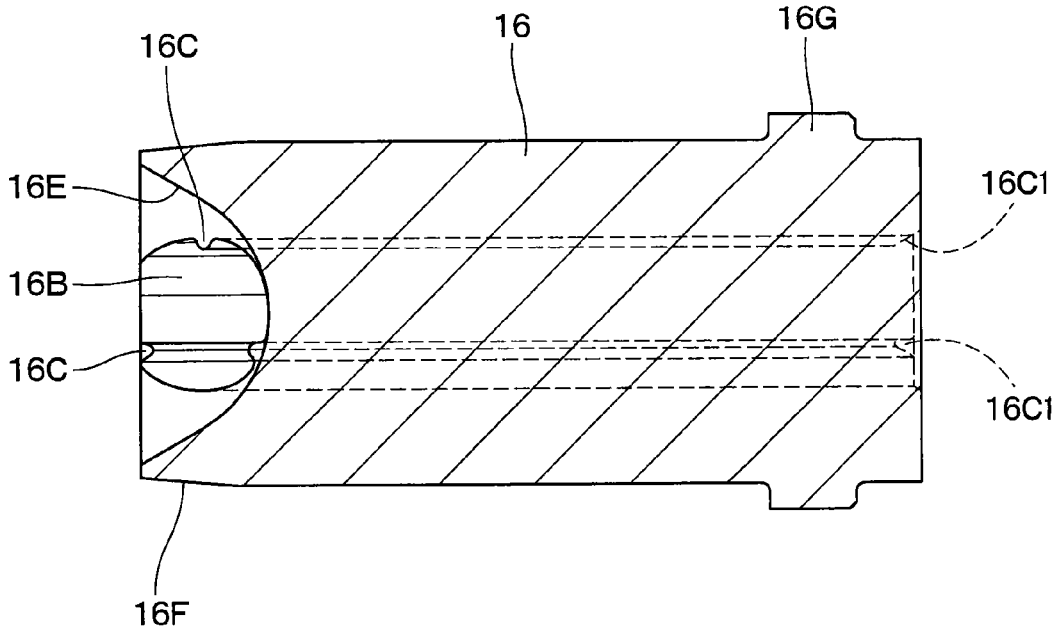
FIG. 13 is a longitudinal cross section showing the positioning member as viewed in the direction of arrows XIII-XIII in FIG. 12.
Figure 14:
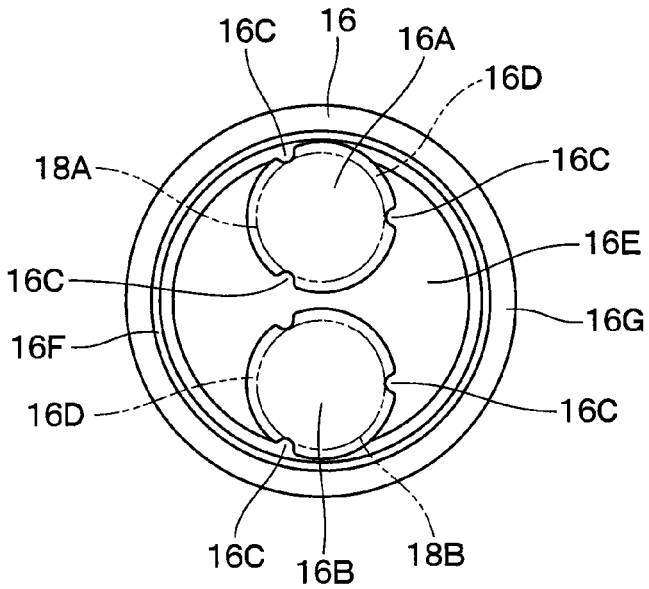
FIG. 14 is a left side view showing the positioning member as viewed in the direction of arrows XIV-XIV in FIG. 12.

As shown in FIG. 12 to FIG. 14, the positioning member 16 is provided in the front end 15C of the tube body 15, and has two tube positioning holes 16A and 16B that axially penetrate therein. Further, each of the tube positioning holes 16A and 16B is formed as a circular hole having an inner diameter dimension larger than an outer diameter dimension of each of the paint tubes 18A and 18B.

Three projecting portions 16C are provided on an inner peripheral surface of each of the tube positioning holes 16A and 16B by an equal interval (interval of approximately 120 degrees) in the circumferential direction, for example. Each projecting portion 16C is arranged to axially extend in a state of projecting to an inner diameter side. Each of the three projecting portions 16C, by making a top part that is in the innermost diameter position in contact with the outer peripheral surface of each of the paint tubes 18A and 18B, supports each of the paint tubes 18A and 18B to an axis center position of each of the tube positioning holes 16A and 16B. Each of the projecting portions 16C is provided with a chamfered portion 16C1 that is formed in a rear end position where each of the paint tubes 18A and 18B is inserted. The chamfered portion 16C1 is formed in such a manner as to be able to guide each of the paint tubes 18A and 18B in each of the tube positioning holes 16A and 16B for smooth insert.

By thus making the three pieces of the projecting portions 16C in contact with the outer peripheral surface of each of the paint tubes 18A and 18B, a wash fluid ejecting port 16D is formed between the inner peripheral surface of each of the tube positioning holes 16A and 16B and the outer peripheral surface of each of the paint tubes 18A and 18B. The wash fluid ejecting port 16D is formed in a circular shape by circularly combining three arc-shaped spaces. The wash fluid ejecting ports 16D eject the wash fluid which is wash liquid or wash air toward front ends 18A3 and 18B3 of the paint tubes 18A and 18B.

The positioning member 16 is provided with a concave curved surface portion 16E in a concave curved shape formed in a front end position facing the rotary atomizing head 7. The concave curved surface portion 16E is formed as a concave spherical surface or a concave conic surface on which a surface level difference from the open end to the deepest portion is small, and each of the tube positioning holes 16A and 16B is opened to the concave curved surface portion 16E. A front end outer periphery of the positioning member 16 forms part of a reduced diameter portion 16F that is reduced in diameter toward the front side. As a result, the paint attached to the front end side of the positioning member 16 can easily be washed out by eliminating almost all of flat sections in a front end of the positioning member 16.

Figure 7:
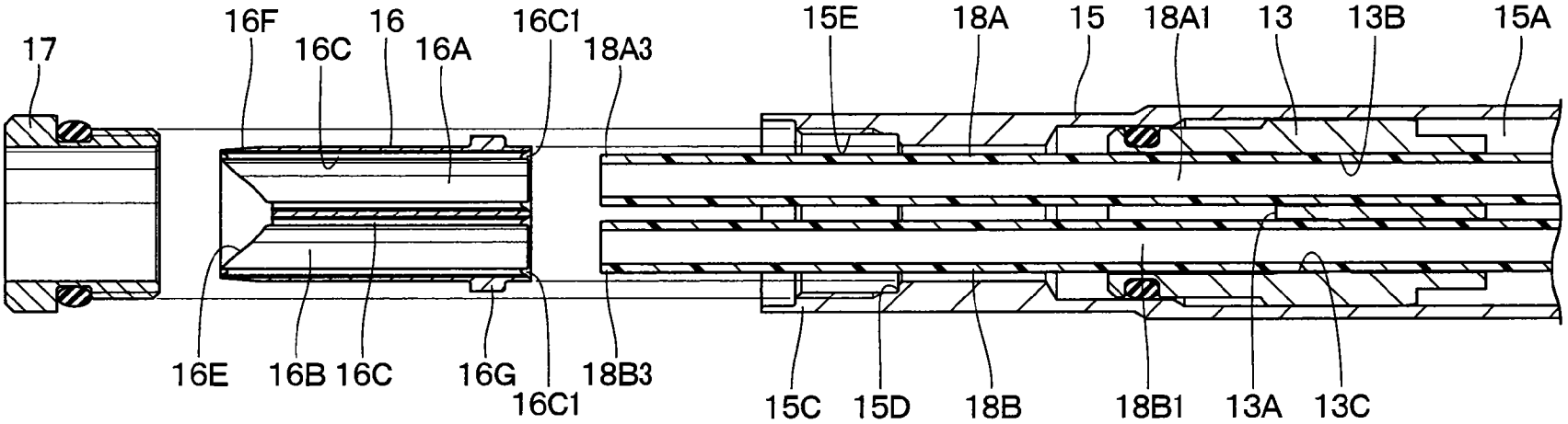
FIG. 7 is a partially enlarged, exploded longitudinal cross section showing the tube body, the positioning member, the fixing tubular body, and the paint tube in an exploded state.

A flange portion 16G is formed to increase in diameter on an outer peripheral surface of the positioning member 16 to be positioned closer to the base end. As shown in FIG. 7, the positioning member 16 is inserted in the tube body 15 from the front end 15C to cause the flange portion 16G to be in contact with the stepped portion 15D of the tube body 15. In this state, when the fixing tubular body 17 is screwed into the female screw portion 15E, the positioning member 16 can be mounted to the front end 15C of the tube body 15.

The positioning member 16 herein positions the front ends 18A3 and 18B3 of the paint tubes 18A and 18B to center positions of the respective tube positioning holes 16A and 16B by inserting the front ends 18A3 and 18B3 in the respective tube positioning holes 16A and 16B. At this insert work, since each of the projecting portions 16C provided on the inner peripheral surface of each of the tube positioning holes 16A and 16B makes contact with the outer peripheral surface of each of the paint tubes 18A and 18B, as the paint tubes 18A and 18B deviates largely from the tube positioning holes 16A and 16B, there is a possibility that the respective projecting portions 16C damage the paint tubes 18A and 18B. However, the positioning member 16 is arranged to be mounted to the tube body 15 from a side of the front end 15C, and the chamfered portion 16C1 is formed in the base end of the positioning member 16. Therefore, the tube positioning holes 16A and 16B can easily be in agreement with the paint tubes 18A and 18B in positioning.

Figure 15:
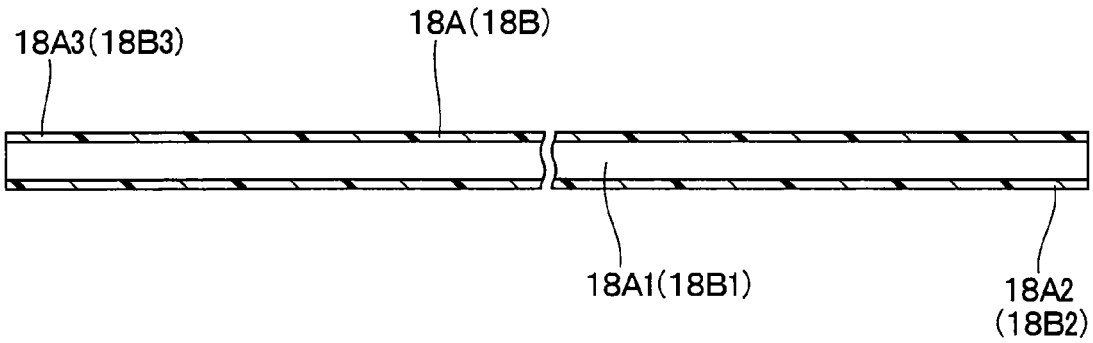
FIG. 15 is a longitudinal cross section showing the paint tube as a single unit in an enlarged state.

Designated at 18A and 18B are plural pieces, for example, two pieces of the resin paint tubes provided to axially extend in the tube through hole 15A of the tube body 15. Each of the two paint tubes 18A and 18B is formed of a resin material having water repellency and oil repellency, for example, a fluorinated resin material, more specifically, as shown in FIG. 15, polytetrafluoroethylene (PTFE) or tetrafluoroethylene-hexafluoropropylenecopolymer (FEP). On top of that, each of the paint tubes 18A and 18B is formed as a tubular body an inside of which constitutes each of the paint passages 18A1 and 18B1. The respective paint tubes 18A and 18B have base ends 18A2 and 18B2 that are mounted to the tube joints 12F and 12G provided in the connecting member 12, and front ends 18A3 and 18B3 that are inserted in the respective tube positioning holes 16A and 16B of the positioning member 16. Further, the halfway section of each of the paint tubes 18A and 18B in the length direction is inserted through each of holding holes 13B and 13C to be held by the intermediate holding member 13.

The paint tubes 18A and 18B formed by polytetrafluoroethylene (PTFE) or tetrafluoroethylene-hexafluoropropylenecopolymer (FEP) are available as inexpensive commercially available products sold in general. It should be noted that an example of the resin material having water repellency and oil repellency may include a silicone resin material (polymethylsiloxane resin material) or tetrafluoroethylene-perfluoroalkylviynlethelcopolymer (PFA).

Here, since each of the commercially available paint tubes 18A and 18B formed of polytetrafluoroethylene (PTFE) or tetrafluoroethylene-hexafluoropropylenecopolymer (FEP) is stored (sold) in a state of being curled, it has peculiar winding to be curved. Further, each of the resin paint tubes 18A and 18B has elasticity, and is easily deformed by the movement at coating. In contrast, the intermediate holding member 13 is provided in the feed tube 11 for holding the halfway section of each of the paint tubes 18A and 18B in the length direction, and besides, the positioning member 16 is provided therein for positioning the front ends 18A3 and 18B3 of the paint tubes 18A and 18B in the length direction. Therefore, the front ends 18A3 and 18B3 of the paint tubes 18A and 18B can fix the ejecting direction of the paint toward the rotary atomizing head 7 by the tube positioning holes 16A and 16B of the positioning member 16.

It should be noted that, as shown in FIG. 1, a rotational speed detector 19 is provided to be positioned in rear of the air motor 5, and the rotational speed detector 19 detects a rotational speed of the turbine 5B in the air motor 5.

The feed tube 11 has the configuration as described above, and next, an assembly work of the feed tube 11 and a mounting work of the feed tube 11 to the coating machine 1 will be explained.

As shown in FIG. 9, at the assembly work of the feed tube 11, the base end of the wash fluid tube 14 is connected to the wash fluid supplying port 12E of the connecting member 12, and the front end thereof is connected to the wash fluid flow out passage 13D of the intermediate holding member 13. As a result, the connecting member 12 and the intermediate holding member 13 are arranged to have a predetermined interval dimension therebetween, and form a part of the flow route for causing the wash fluid to flow therein.

When the connecting member 12, the intermediate holding member 13 and the wash fluid tube 14 are assembled, as shown in FIG. 6 the paint tubes 18A and 18B are inserted in the holding holes 13B and 13C of the intermediate holding member 13. Next, the base ends 18A2 and 18B2 of the respective paint tubes 18A and 18B are connected to the tube joints 12F and 12G of the connecting member 12. When the paint tubes 18A and 18B respectively are connected to the tube joints 12F and 12G of the connecting member 12, the intermediate holding member 13 and the respective paint tubes 18A and 18B are covered with the tube body 15.

Next, as shown in FIG. 7, the positioning member 16 is inserted in the side of the front end 15C of the tube body 15, and the fixing tubular body 17 is used to fix the positioning member 16 to the front end 15C of the tube body 15. At this time, since the positioning member 16 is mounted to the tube body 15 from the side of the front end 15C, the front ends 18A3 and 18B3 of the respective paint tubes 18A and 18B can easily be inserted in the tube positioning holes 16A and 16B. Therefore, it is possible to assemble the feed tube 11 of the double type provided with the two paint tubes 18A and 18B arranged in parallel.

As shown in FIG. 1, in a case of mounting the feed tube 11 to the coating machine 1, the connecting member 12 is inserted in the connecting member accommodating portion 4 of the housing 2, and in this state, a fixing ring 20 is screwed in the female screw portion 4A of the connecting member accommodating portion 4. As a result, the feed tube 11 can be mounted to be integral with the housing 2.

The rotary atomizing head type coating machine 1 according to the first embodiment has the configuration as described above, and next, an explanation will be made of a movement when the coating machine 1 is used to perform a coating work. Description will be made of a case where at this coating work, for example, a solvent paint is supplied to the first paint supplying passage 10A and a water-based paint is supplied to the second paint supplying passage 10B, thus applying the paints having different properties.

The compressed air is supplied to the turbine 5B in the air motor 5 to rotate the rotary atomizing head 7 in a high speed together with the rotational shaft 6. In this state, in a case of applying the solvent paint, the solvent paint supplied to the first paint supplying passage 10A is caused to flow from the first paint supplying port 12C of the connecting member 12 into the paint tube 18A, and is supplied from the front end 18A3 of the paint tube 18A to the rotary atomizing head 7. Thereby, the solvent paint can be sprayed as paint particles that are atomized from the rotary atomizing head 7. At this time, as a high voltage is applied to the paint (paint particles) by the high voltage generator 9, the paint particles charged with the high voltage can fly toward a coating object that is connected to the earth to perform an efficient coating thereto.

Next, description will be made of a case of applying a water-based paint instead of the solvent paint. In this case, it is necessary to wash out the solvent paint remaining in the connecting member 12, the paint tube 18A, the rotary atomizing head 7 and the like. As the description is made of the wash work, the wash fluid (for example, thinner or air) is caused to flow from the first paint supplying passage 10A and the first paint supplying port 12C of the connecting member 12 into the paint tube 18A to discharge the solvent paint remaining therein for the washing.

On the other hand, the wash fluid is caused to flow via the wash fluid supplying passage (not shown) in the housing 2, the wash fluid supplying port 12E (refer to FIG. 4) of the connecting member 12, the wash fluid tube 14 and the wash fluid flow out passage 13D of the intermediate holding member 13, and is ejected from the respective wash fluid ejecting ports 16D of the positioning member 16 toward the rotary atomizing head 7. Thereby, it is possible to wash the solvent paint attached to the rotary atomizing head 7. At the same time with it, it is possible to wash out the solvent paint attached to the outer peripheral sides of the front ends 18A3 and 18B3 of the respective paint tubes 18A and 18B, the concave curved surface portion 16E of the positioning member 16 and the like.

In this way, the paint tubes 18A and 18B each are formed of the resin material having water repellency and oil repellency. As a result, the paint attached to the paint tube 18A can certainly be washed out by only supplying a small amount of wash fluid. Further, the paint attached to the front end 18B3 of the other paint tube 18B and the concave curved surface portion 16E of the positioning member 16 also can easily be washed out.

When the solvent paint as the previous color paint is thus washed out, a coating work of the water-based paint will be performed. In this case, the water-based paint that is supplied to the second paint supplying passage 10B is caused to flow in the second paint supplying port 12D of the connecting member 12 and the paint tube 18B, and is supplied from the front end 18B3 of the paint tube 18B toward the rotary atomizing head 7. Thereby, the water-based paint can be sprayed from the rotary atomizing head 7.

In this way, according to the first embodiment, the feed tube 11 comprises the connecting member 12 that is provided in the rear side of the air motor 5 and includes the two paint supplying ports 12C and 12D, the elongated tube body 15 that comprises the hollow tubular body forming the tube through hole 15A at the inner peripheral side, the base end of which is connected to the connecting member 12, and the front end of which extends in the rotational shaft 6 toward the rotary atomizing head 7, the positioning member 16 that is provided in the front end 15C of the tube body 15 and includes the two tube positioning holes 16A and 16B axially penetrating therein, and the two paint tubes 18A and 18B the base ends 18A2 and 18B2 of which are connected to the paint supplying ports 12C and 12D of the connecting member 12 and the front ends 18A3 and 18B3 of which are inserted through the tube positioning holes 16A and 16B of the positioning member 16. Further, the paint tubes 18A and 18B are formed using a resin material having water repellency and oil repellency and are formed as the tubular bodies having the paint passages 18A1 and 18B1 therein.

Accordingly, even if the paint is attached to the surfaces (the inner surface, the outer surface and the like) of the resin paint tubes 18A and 18B having the water repellency and oil repellency, the paint can easily be washed out by only supplying a small amount of the washing fluid. Further, since the two paint tubes 18A and 18B are together positioned in the positioning member 16, as the paint is ejected from the one paint tube 18A, the paint enters into the front end 18B3 of the other paint tube 18B that has not ejected the paint. However, at the time of washing the one paint tube 18A, the paint that enters into the front end 18B3 of the other paint tube 18B can also easily be washed out.

On the other hand, the feed tube 11 is provided with the connecting member 12 and the positioning member 16, the base ends 18A2 and 18B2 of the respective paint tubes 18A and 18B are connected to the respective paint supplying ports 12C and 12D of the connecting member 12, the front ends 18A3 and 18B3 of the respective paint tubes 18A and 18B are inserted through the tube positioning holes 16A and 16B of the positioning member 16. At this time, as the paint tubes 18A and 18B are formed of flexible materials, there are some cases where the paint tubes 18A and 18B have peculiar winding. However, since the front ends 18A3 and 18B3 of the paint tubes 18A and 18B are positioned by the tube positioning holes 16A and 16B of the positioning member 16, the front ends 18A3 and 18B3 can be fixed toward the rotary atomizing head 7. Further, the tube body 15 can cover and hide the weak paint tubes 18A and 18B for protection.

As a result, the paint that is attached to the surfaces of the paint tubes 18A and 18B can certainly be washed out for a short time by a small amount of the washing fluid. On top of that, the feed tube 11 can be manufactured inexpensively by using the commercially available paint tubes 18A and 18B.

Each of the tube positioning holes 16A and 16B of the positioning member 16 is provided with the three projecting portions 16C projecting to the inner peripheral side and the top parts of the respective projecting portions 16C are provided to make contact with the outer peripheral surface of each of the paint tubes 18A and 18B. Thereby, the gaps can be formed between the inner peripheral surface of each of the tube positioning holes 16A and 16B and the outer peripheral surface of each of the paint tubes 18A and 18B to position the front ends 18A3 and 18B3 of the paint tubes 18A and 18B in the axis center positions of the tube positioning holes 16A and 16B.

On the other hand, the gaps between the inner peripheral surface of each of the tube positioning holes 16A and 16B and the outer peripheral surface of each of the paint tubes 18A and 18B can be used as the wash fluid ejecting ports 16D for ejecting the wash fluid. Thereby, the wash fluid can be supplied directly to the paint that is attached to the outer peripheral of the front ends 18A3 and 18B3 in the paint tubes 18A and 18B to enhance the washing efficiency. The paint that is attached to the rotary atomizing head 7 can also be washed out.

The front end surface of the positioning member 16 is provided with the concave curved surface portion 16E formed in the concave curved shape. Thereby, when the wash fluid is ejected from the wash fluid ejecting port 16D, the wash fluid can be caused to flow in the concave curved surface portion 16E to efficiently wash out the paint attached to the positioning member 16.

Further, the tube through hole 15A of the tube body 15 is provided therein with the intermediate holding member 13, which can hold the halfway section of each of the paint tubes 18A and 18B in the length direction. Therefore, even in a case where the paint tubes 18A and 18B are made of flexible materials or have the peculiar winding, the paint tubes 18A and 18B can be held straight. In addition, the intermediate holding member 13 can axially be positioned by being connected to the connecting member 12 by using the wash fluid tube 14. On top of that, since the inside of the wash fluid tube 14 can be used as the wash fluid passage 14A, the number of components constituting the feed tube 11 can be reduced to achieve an improvement on assembly workability, a reduction in manufacturing costs and the like.

Figure 16:
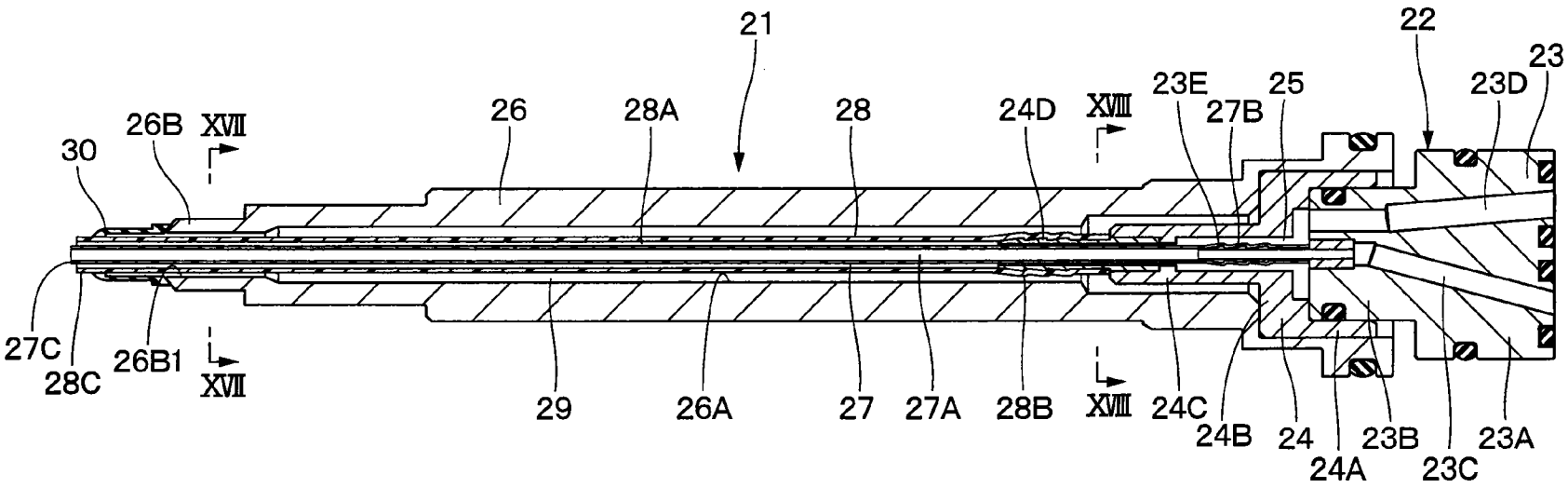
FIG. 16 is a longitudinal cross section showing a feed tube of a triple tubular structure according to a second embodiment in the present invention.
Figure 17:
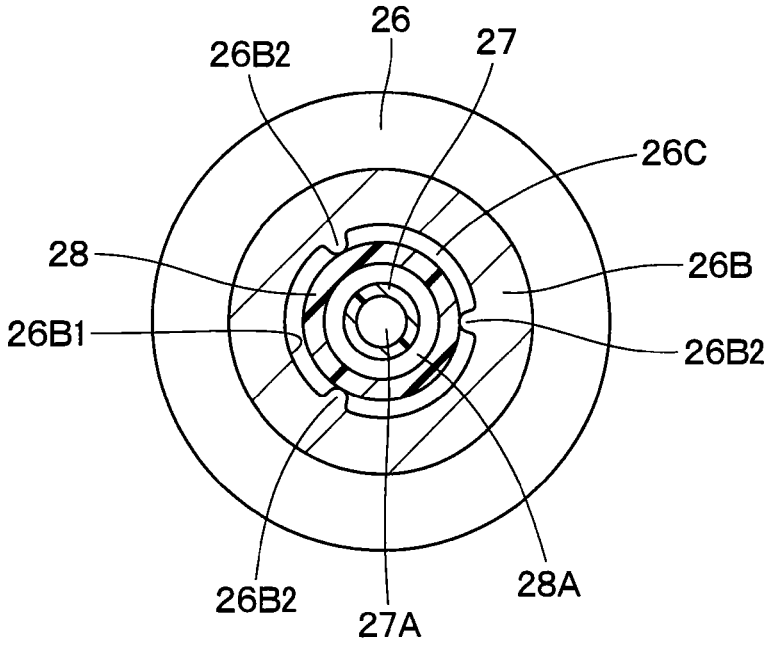
FIG. 17 is an enlarged transverse cross section showing the positioning member of the tube body and the respective paint tubes as viewed in the direction of arrows XVII-XVII in FIG. 16.
Figure 18:
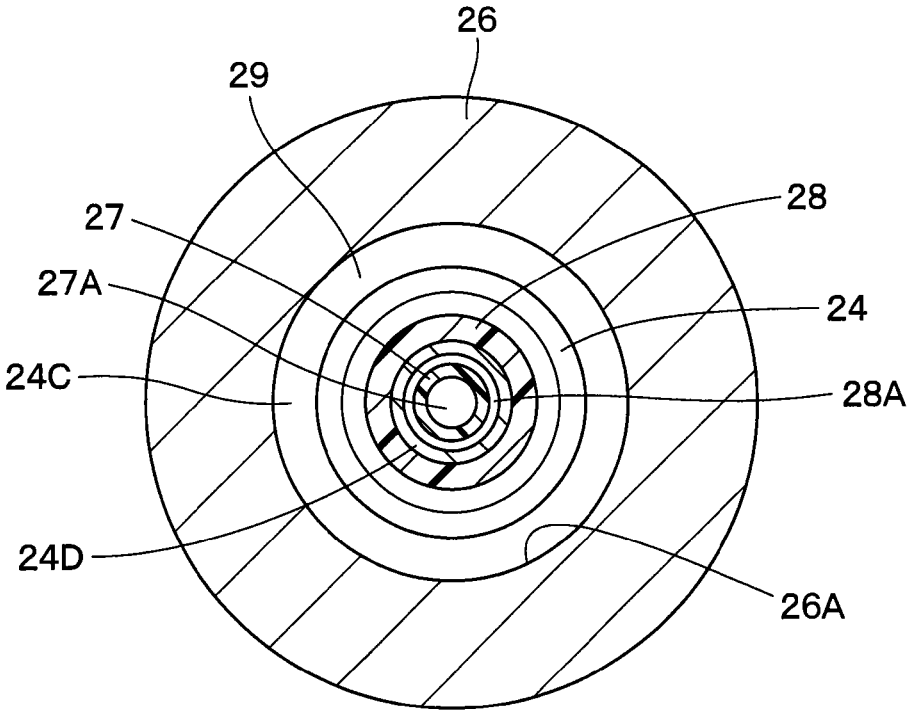
FIG. 18 is an enlarged transverse cross section showing the tube body and the respective paint tubes as viewed in the direction of arrows XVIII-XVIII in FIG. 16.

Next, FIG. 16 to FIG. 18 show a second embodiment in the present invention. A feed tube according to the present embodiment is characterized in that a paint tube is formed by an inner tube and an outer tube that are arranged concentrically. That is, the feed tube is formed of a triple tubular structure including a tube body, the inner tube and the outer tube. Thereby, a first paint passage is formed in the inner tube, a second paint passage is formed in a circular space between the inner tube and the outer tube, and a wash fluid passage is formed in a circular space between the outer tube and a tube through hole of the tube body. In the second embodiment, the component elements that are identical to those of the foregoing first embodiment will be simply denoted by the same reference numerals to avoid repetitions of similar explanations.

In FIG. 16, designated at 21 is the feed tube according to the second embodiment. The feed tube 21 is used, for example, to apply a mixed paint (two-liquid paint) that is formed by mixing a main agent including pigment and the like, and a curing agent in the rotary atomizing head 7 for coating. The feed tube 21 is formed of a triple tubular structure including the connecting member 22, the tube body 26, the inner tube 27 and the outer tube 28.

Indicated at 22 is the connecting member according to the second embodiment. The connecting member 22 is configured of a base section 23 and a coupling section 24, which will be described later, axially jointed.

The base section 23 constitutes a main body of the connecting member 22, and is formed as a stepped columnar body comprising a large diameter portion 23A positioned at a rear side and a small diameter portion 23B positioned at a front side. The base section 23 is provided with a first paint supplying port 23C and a second paint supplying port 23D. For example, the first paint supplying port 23C opened to an axis center position of a front end surface of the small diameter portion 23B is connected to a main agent supplying source (not shown) that supplies a main agent including pigment and the like. On the other hand, the second paint supplying port 23D opened to the periphery of the first paint supplying port 23C is connected to a curing agent supplying source (not shown). A tube joint 23E similar to the tube joints 12F and 12G according to the first embodiment is provided to project in the center of the small diameter portion 23B in a state of being communicated with the first paint supplying port 23C, and the inner tube 27 to be described later is connected to the tube joint 23E.

The coupling section 24 is coupled coaxially with the base section 23 at the front side, and is formed as a stepped tubular body. The coupling section 24 is formed of a large diameter tubular portion 24A that is inserted around the small diameter portion 23B of the base section 23, a circular, reduced diameter portion 24B that is formed by reducing a diameter of a front end of the large diameter tubular portion 24A, and a small diameter tubular portion 24C that extends forward from the axis center position of the reduced diameter portion 24B. In the coupling section 24, an inner diameter dimension of each of the reduced diameter portion 24B and the small diameter tubular portion 24C is set to a larger dimension than an outer diameter dimension of the inner tube 27. As a result, a connecting passage 25 that axially extends is formed in the coupling section 24. The connecting passage 25 is arranged to connect the second paint supplying port 23D of the base section 23 and the outer tube 28 to be described later.

A tube joint 24D is provided to project in a front end of the small diameter tubular portion 24C, being communicated with the connecting passage 25 (second paint supplying port 23D). The tube joint 24D has the configuration similar to that of each of the tube joints 12F and 12G according to the first embodiment except for being formed in a large diameter such that the inner tube 27 can be inserted therein with an interval.

The tube body 26 is provided to extend forward from the coupling section 24, and covers and hides the outer tube 28 to be described later. The tube body 26 comprises an elongated hollow tubular body that is provided with a tube through hole 26A at an inner peripheral side, and the base end increases in diameter step by step, and is fitted on an outer periphery of the large diameter tubular portion 24A of the coupling section 24.

On the other hand, the front end of the tube body 26 decreases in diameter step by step, and forms a positioning member 26B. As shown in FIG. 17, a tube positioning hole 2631 is formed in an axis center position of the positioning member 26B to axially penetrate therein, and the tube positioning hole 26B1 is formed as a circular hole having an inner diameter dimension larger than an outer diameter dimension of the outer tube 28.

Projecting portions 26B2 are provided on an inner peripheral surface of the tube positioning hole 26B1 to axially extend and project to an inner diameter side, and, for example, three projecting portions 26B2 are provided by an equal interval therebetween (interval of approximately 120 degrees) in the circumferential direction. Each of the three projecting portions 26B2, by making a top part that is in the innermost diameter position in contact with the outer peripheral surface of the outer tube 28, supports the outer tube 28 to an axis center position of the tube positioning hole 26B1.

By thus making the three pieces of the projecting portions 26B2 in contact with the outer peripheral surface of the outer tube 28, three pieces of arc-shaped spaces are formed between the inner peripheral surface of the tube positioning hole 26B1 and the outer peripheral surface of the outer tube 28. That is, the three pieces of the arc-shaped spaces are used to form circular wash fluid ejecting ports 26C. The wash fluid ejecting port 26C ejects the wash fluid toward a front end 28C of the outer tube 28.

Indicated at 27 is the inner tube that is provided to axially extend in the nearest position to an axis line of the feed tube 21, and forms a paint tube together with the outer tube 28 to be described. The inner tube 27 is formed as a tubular body an inside of which is a main agent passage 27A by using a resin material having water repellency and oil repellency to be similar to the paint tubes 18A and 18B according to the first embodiment. The inner tube 27 has a base end 27B that is mounted to the tube joint 23E provided in the base section 23, and a front end 27C that projects from the tube body 26. Thereby, the inner tube 27 can eject a main agent supplied from the first paint supplying port 23C toward the rotary atomizing head 7.

Indicated at 28 is the outer tube that is provided outside of the inner tube 27, and forms the paint tube together with the inner tube 27. The outer tube 28 is formed as a tubular body made of a resin material having water repellency and oil repellency to be similar to the paint tubes 18A and 18B according to the first embodiment. A curing agent passage 28A formed of a circular space is formed between the outer tube 28 and the inner tube 27. As shown in FIG. 18, the outer tube 28 has a base end 28B that is mounted to the tube joint 24D provided in the coupling section 24, and a front end 28C that is inserted through the tube positioning hole 26B1 of the positioning member 26B in the tube body 26. The outer tube 28 has the front end 28C that projects from the tube positioning hole 26B1 and extends to a position backing away slightly from the front end 27C of the inner tube 27. Thereby, the outer tube 28 can eject a curing agent supplied from the second paint supplying port 23D and the connecting passage 25 toward the rotary atomizing head 7.

The wash fluid passage 29 is formed between the inner peripheral surface of the tube body 26 and the outer peripheral surface of the outer tube 28, and the wash fluid passage 29 forms part of the circular passage in which the wash fluid flows. The wash fluid passage 29 has the upstream side that is connected to the wash fluid supplying port (not shown) provided in the coupling section 24, and the downstream side that reaches to the wash fluid ejecting port 26C.

A check valve 30 is provided in a front end of the tube body 26, and is formed as a cylindrical body made of a rubber material having elasticity or the like. A front end of the check valve 30 is reduced in diameter, and makes elastic (liquid-tight) contact with the outer peripheral surface of the outer tube 28. Thereby, the check valve 30 holds the outer tube 28 such that the wash fluid in the wash fluid passage 29 does not leak outside other than at a wash work. On the other hand, the check valve 30 is, at the washing time the wash fluid is supplied, elastically deformed subjected to a pressure from inside to be opened and to eject the wash fluid.

Here, description will be made of a case of assembling the feed tube 21 according to the second embodiment. In this case, the inner tube 27 is connected to the tube joint 23E of the base section 23 forming part of the connecting member 22. In this state, the inner tube 27 is inserted in the tube joint 24D, while the coupling section 24 is coupled to the small diameter portion 23B of the base section 23 for mount. Next, the inner tube 27 is inserted in the outer tube 28, while the outer tube 28 is connected to the tube joint 24D of the coupling section 24. When the respective tubes 27 and 28 are mounted, the tube body 26 is mounted to cover these tubes, and the respective tubes 27 and 28 are arranged to project from the front end of the tube positioning hole 26B1. Thereby, the feed tube 21 can be assembled.

Description will be made of a case of supplying mixed paint (two-liquid paint) toward the rotary atomizing head 7 by using the feed tube 21. In this case, the main agent is supplied from the first paint supplying port 23C of the base section 23 to the main agent passage 27A in the inner tube 27, and at the same time the curing agent is supplied from the second paint supplying port 23D of the base section 23 to the curing agent passage 28A in the outer tube 28 through the connecting passage 25. Thereby, the main agent ejected from the main agent passage 27A and the curing agent ejected from the curing agent passage 28A can be mixed by the rotary atomizing head 7 to be sprayed.

In this way, also in the second embodiment as thus configured, the operational effect substantially similar to that of the first embodiment described before can be obtained. Particularly, according to the second embodiment, the inner tube 27 and the outer tube 28 are arranged concentrically in the tube body 26, thereby making it possible to establish a triple tubular structure comprising the main agent passage 27A at the innermost peripheral side, the circular curing agent passage 28A and the circular wash fluid passage 29. Therefore, the main agent and the curing agent as paints of two different kinds can be mixed in the rotary atomizing head 7 for coating. It should be noted that, as in the first embodiment, the solvent paint and the water-based paint can be used for coating.

Figure 19:
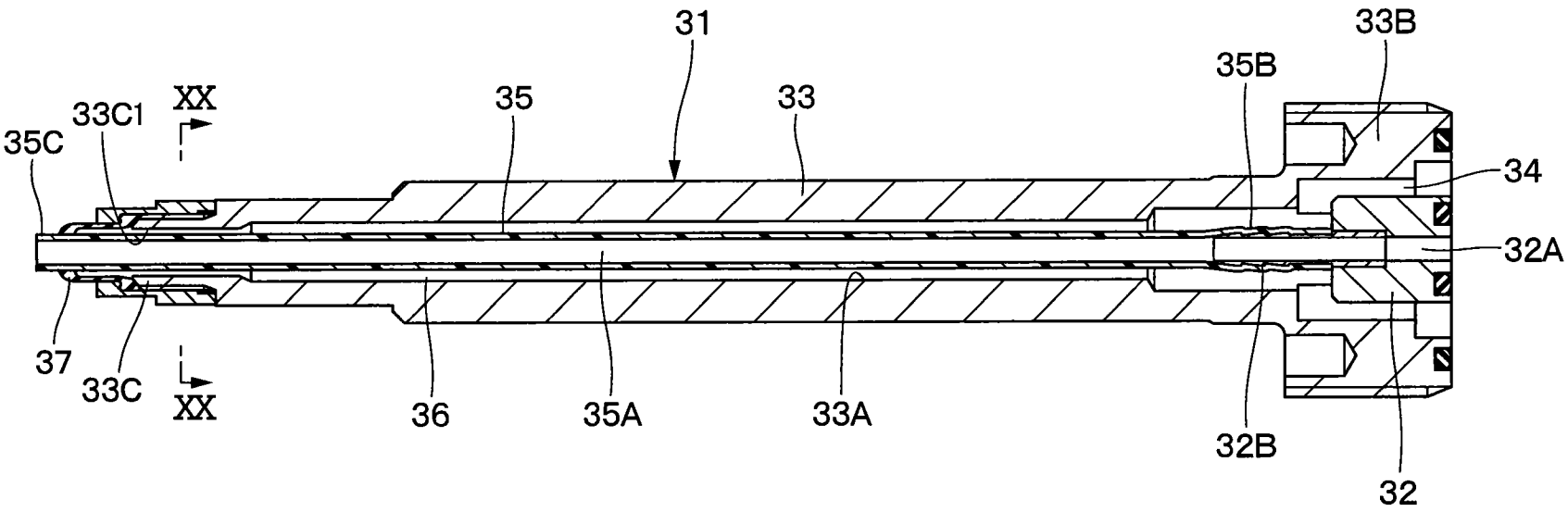
FIG. 19 is a longitudinal cross section showing a single-type feed tube according to a third embodiment in the present invention.
Figure 20:
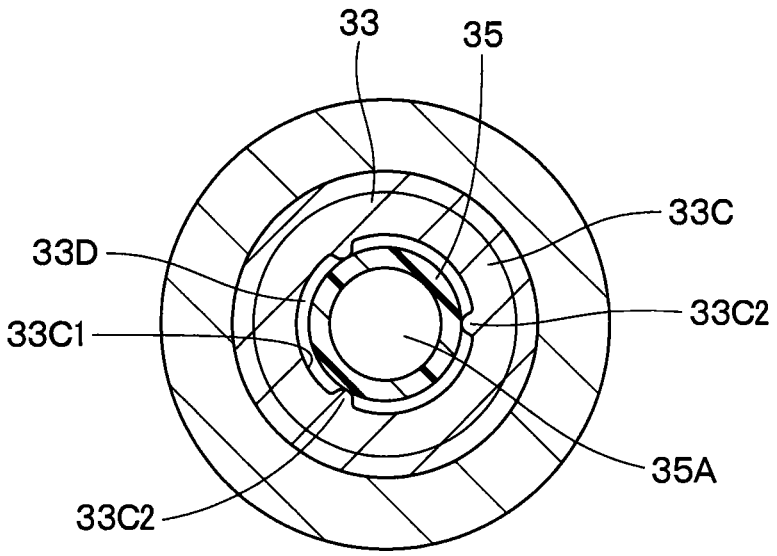
FIG. 20 is an enlarged transverse cross section showing the positioning member of the tube body and the paint tube as viewed in the direction of arrows XX-XX in FIG. 19.

Next, FIG. 19 and FIG. 20 show a third embodiment in the present invention. A feed tube according to the present embodiment is characterized in that a single paint tube is provided in a tube body, an inside of the tube body is formed as a paint passage, and a space between an outer peripheral surface of the paint tube and an inner peripheral surface of the paint tube is formed as a wash fluid passage. In the third embodiment, the component elements that are identical to those of the foregoing first embodiment will be simply denoted by the same reference numerals to avoid repetitions of similar explanations.

In FIG. 19, designated at 31 is the feed tube according to the third embodiment. The feed tube 31 is used to supply paint and wash fluid, for example. The feed tube 31 is configured to include a connecting member 32, a tube body 33, and a paint tube 35.

The connecting member 32 constitutes part of a base end side of the feed tube 31, and is formed as a cylindrical body an inner peripheral side of which is a paint supplying port 32A. The upstream side of the paint supplying port 32A is connected to a color-change valve device (not shown) or the like as a paint supplying source or the like, and a tube joint 32B is mounted to the downstream side thereof. The tube joint 32B is formed as similar to the tube joints 12F and 12G according to the first embodiment.

The tube body 33 is provided to extend forward from the connecting member 32, and covers and hides the paint tube 35 to be described later. The tube body 33 comprises an elongated hollow tubular body that is provided therein with a tube through hole 33A at an inner peripheral side, and the base end constitutes a large-diameter mounting portion 33B that is mounted to the housing 2. On the other hand, the front end of the tube body 33 is reduced in diameter step by step, and forms part of a positioning member 33C. As shown in FIG. 20, a tube positioning hole 33C1 is formed in an axis center position of the positioning member 33C to axially penetrate therein, and the tube positioning hole 33C1 is formed as a circular hole having an inner diameter dimension larger than an outer diameter dimension of the paint tube 35.

Projecting portions 33C2 are provided on an inner peripheral surface of the tube positioning hole 33C1 to axially extend and project to an inner diameter side, and, for example, three projecting portions 33C2 are provided by an equal interval (interval of approximately 120 degrees) with each other in the circumferential direction. Each of the three projecting portions 33C2, by making a top part that is in the innermost diameter position in contact with the outer peripheral surface of the paint tube 35, supports the paint tube 35 in an axis center position of the tube positioning hole 33C1.

Thus, in a state of making the respective projecting portions 33C2 in contact with the outer peripheral surface of the paint tube 35, three pieces of arc-shaped spaces can be formed between the inner peripheral surface of the tube positioning hole 33C1 and the outer peripheral surface of the paint tube 35. The three pieces of the arc-shaped spaces can be used to form circular wash fluid ejecting ports 33D. The wash fluid ejecting port 33D ejects the wash fluid toward a front end 35C of the paint tube 35.

A wash fluid supplying port 34 is formed as a circular space that is provided between the connecting member 32 and the mounting portion 33B of the tube body 33. The upstream side of the wash fluid supplying port 34 is connected to the wash fluid supplying passage of the housing 2, and the downstream side thereof is connected to a wash fluid passage 36 to be described later.

Indicated at 35 is the single paint tube that is provided along an axis line of the feed tube 31. The paint tube 35 is formed as a tubular body an inside of which is a paint passage 35A by using a resin material having water repellency and oil repellency to be similar to the paint tubes 18A and 18B according to the first embodiment. The paint tube 35 has a base end 35B that is mounted to a tube joint 32B provided in the connecting member 32, and a front end 35C that projects from the tube positioning hole 33C1 of the tube body 33. Thereby, the paint tube 35 can eject paint supplied from the paint supplying port 32A toward the rotary atomizing head 7 from the front end 35C.

The wash fluid passage 36 is formed between the inner peripheral surface of the tube body 33 and the outer peripheral surface of the paint tube 35, and forms part of the flow passage in which the wash fluid flows. The wash fluid passage 36 has the upstream side that is connected to the wash fluid supplying port 34, and the downstream side that reaches to the wash fluid ejecting port 33D.

A check valve 37 is provided in a front end of the tube body 33, and is formed as a cylindrical body made of a rubber material having elasticity or the like. A front end of the check valve 37 is reduced in diameter, and makes elastic (liquid-tight) contact with the outer peripheral surface of the paint tube 35. Thereby, the check valve 37 holds the paint tube 35 such that the wash fluid in the wash fluid passage 36 does not leak outside other than at a wash work, and the check valve 37, at the washing time when the wash fluid is supplied, is elastically deformed subjected to a pressure from inside to be opened and to eject the wash fluid.

Here, description will be made of a case of assembling the feed tube 31 according to the third embodiment. In this case, the paint tube 35 is connected to the tube joint 32B of the connecting member 32. In this state, the paint tube 35 is inserted in the tube through hole 33A from the mounting portion 33B of the tube body 33, and the front end 35C of the paint tube 35 is arranged to project from the tube positioning hole 33C1 of the positioning member 33C. Further, the connecting member 32 is mounted in the mounting portion 33B of the tube body 33, and the check valve 37 is mounted to the front end of the tube body 33. Thereby, the feed tube 31 can be assembled.

Description will be made of a case of supplying paint toward the rotary atomizing head 7 by using the feed tube 31. In this case, the paint supplied from the paint supplying port 32A of the connecting member 32 is ejected from the paint passage 35A in the paint tube 35 toward the rotary atomizing head 7, thereby making it possible to spray the paint from the rotary atomizing head 7.

In this way, also in the third embodiment as thus configured, the operational effect substantially similar to that of the first embodiment described before can be obtained. Particularly, according to the third embodiment, the paint passage 35A and the wash fluid passage 36 can be formed by only providing the single paint tube 35 in the tube through hole 33A of the tube body 33 to constitute the general feed tube 31 in a simple manner.

Figure 21:
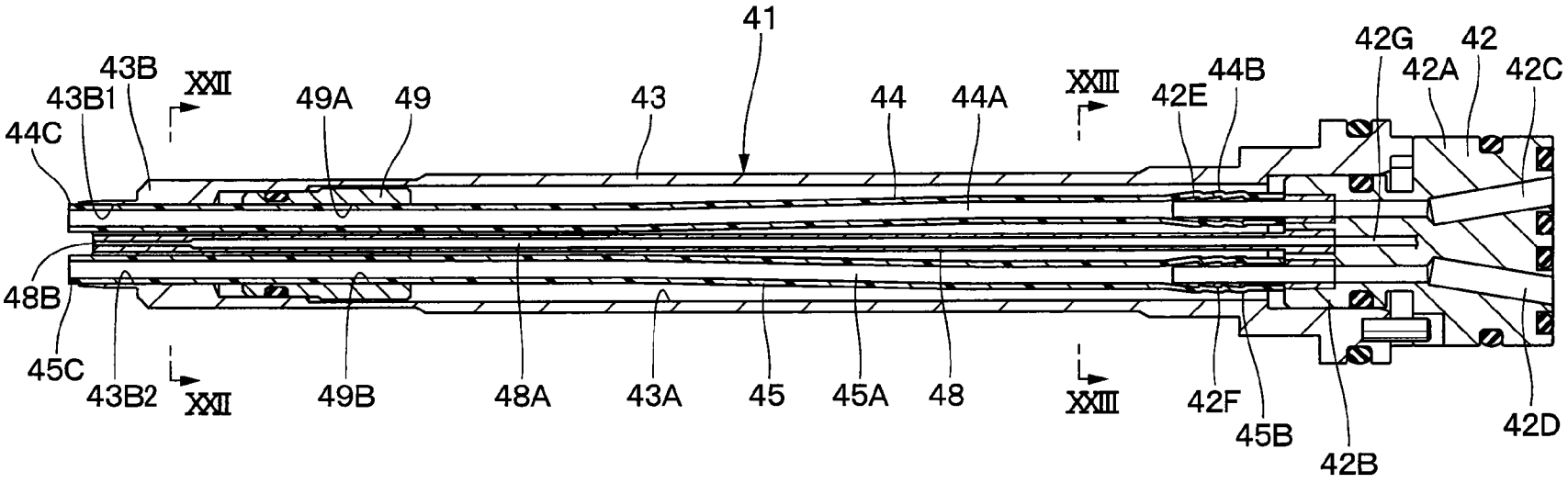
FIG. 21 is a longitudinal cross section showing a multi-type feed tube according to a fourth embodiment in the present invention.
Figure 22:
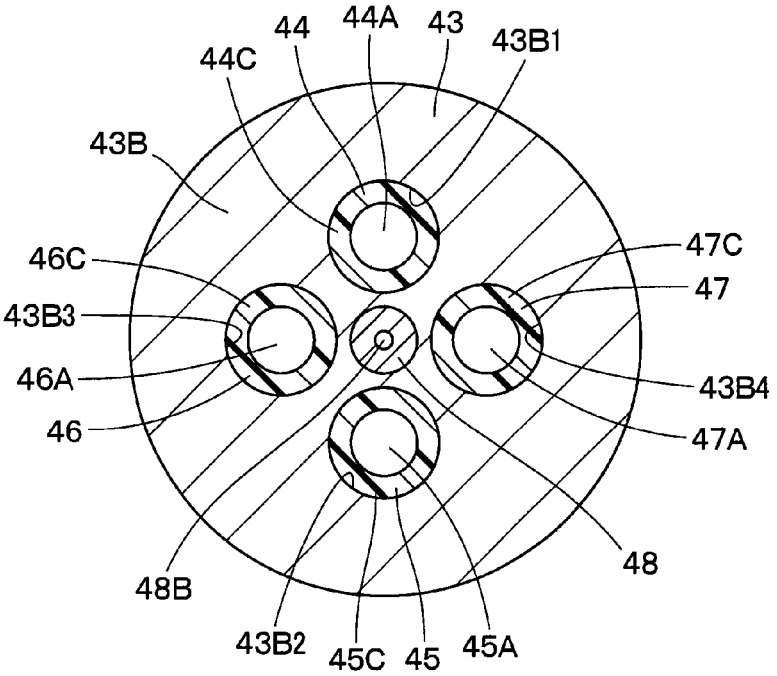
FIG. 22 is an enlarged transverse cross section showing the positioning member of the tube body, the respective paint tubes and the wash fluid tube as viewed in the direction of arrows XXII-XXII in FIG. 21.
Figure 23:
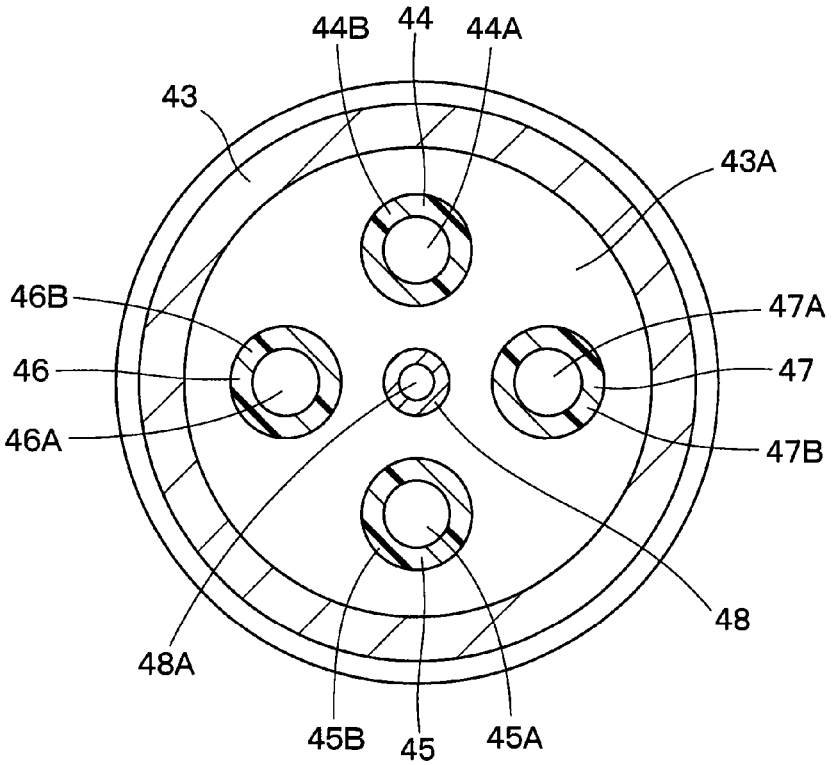
FIG. 23 is an enlarged transverse cross section showing the tube body, the respective paint tubes and the wash fluid tube as viewed in the direction of arrows XXIII-XXIII in FIG. 21.

Next, FIG. 21 to FIG. 23 show a fourth embodiment in the present invention. A feed tube according to the present embodiment is characterized in that four paint tubes and a single wash fluid tube are provided in the feed tube. In the fourth embodiment, the component elements that are identical to those of the foregoing first embodiment will be simply denoted by the same reference numerals to avoid repetitions of similar explanations.

In FIG. 21, designated at 41 is the feed tube according to the fourth embodiment. The feed tube 41 is used, for example, to supply paints of plural colors and wash fluid. The feed tube 41 is configured to include a connecting member 42, a tube body 43, paint tubes 44, 45, 46 and 47, a wash fluid tube 48, and an intermediate holding member 49.

The connecting member 42 constitutes the feed tube 41, and is formed as a stepped columnar body comprising a large diameter portion 42A positioned at a rear side and a small diameter portion 42B positioned at a front side. The connecting member 42 is provided with a first paint supplying port 42C, a second paint supplying port 42D, a third paint supplying port and a fourth paint supplying port (none of them is shown), and the respective paint supplying ports 42C, 42D and the like are connected to different paint supplying sources. Tube joints 42E, 42F and the like (only two tube joints are shown) similar to the tube joints 12F and 12G according to the first embodiment are provided in the respective paint supplying ports 42C, 42D and the like, and the paint tubes 44, 45, 46 and 47 to be described later are connected to the respective tube joints 42E, 42F and the like. On the other hand, a wash fluid supplying port 42G connected to the wash fluid supplying source is provided in an axis center position of the connecting member 42, and the wash fluid tube 48 to be described later is connected to the wash fluid supplying port 42G.

The tube body 43 is provided to extend forward from the connecting member 42, and covers and hides the paint tubes 44, 45, 46 and 47 to be described later, and the like. The tube body 43 comprises an elongated hollow tubular body that is provided with a tube through hole 43A at an inner peripheral side, and the base end increases in diameter step by step, and is fitted on an outer periphery of the small diameter portion 42B of the connecting member 42. On the other hand, the front end of the tube body 43 is formed as a positioning member 43B, and as shown in FIG. 22, the positioning member 43B is provided with four tube positioning holes 43B1, 43B2, 43B3 and 43B4 formed by intervals in the circumferential direction, for example. Front ends 44C, 45C, 46C and 47C of the respective paint tubes 44, 45, 46 and 47 to be described later are inserted and fitted in the respective tube positioning holes 43B1, 43B2, 43B3 and 43B4. Further, the wash fluid tube 48 to be described later is mounted to an axis center position of the positioning member 43B.

Indicated at 44, 45, 46 and 47 are plural pieces, for example, four pieces of the paint tubes provided in the tube body 43. Each of the four paint tubes 44, 45, 46 and 47 is formed as a tubular body an inside of which is each of paint passages 44A, 45A, 46A and 47A by using a resin material having water repellency and oil repellency as similar to the paint tubes 18A and 18B according to the first embodiment. Each of the paint tubes 44, 45, 46 and 47 has each of base ends 44B, 45B, 46B and 47B that are mounted to the tube joint 42E and the like provided in the connecting member 42, and the front ends 44C, 45C, 46C and 47C project from the tube positioning holes 43B1, 43B2, 43B3 and 43B4 of the tube body 43. Thereby, the respective paint tubes 44, 45, 46 and 47 can eject paints of the respective colors supplied from the paint supplying ports 42C, 42D and the like toward the rotary atomizing head 7.

The wash fluid tube 48 is provided in an axis center position in the tube body 43, and an inside of the wash fluid tube 48 forms a wash fluid passage 48A. The upstream side of the wash fluid passage 48A is connected to the wash fluid supplying port 42G of the connecting member 42, and the downstream side thereof forms a wash fluid ejecting port 48B, which is arranged in the center of the positioning member 43B through an intermediate holding member 49 to be described later. Therefore, the wash fluid tube 48 can supply wash fluid from the wash fluid ejecting port 48B toward the rotary atomizing head 7.

The intermediate holding member 49 is arranged in the tube through hole 43A to be positioned at a front end side of the tube body 43, and holds the halfway section of each of the paint tubes 44, 45, 46 and 47 in the length direction to a predetermined position. The intermediate holding member 49 is formed as a columnar body that is inserted in the tube through hole 43A, and is provided with four holding holes 49A, 49B and the like (only two holes are shown) formed by intervals in the circumferential direction to axially penetrate therein. The respective paint tubes 44, 45, 46 and 47 are inserted in the respective holding holes 49A, 49B and the like, thereby making it possible to hold the halfway section of each of the respective paint tubes 44, 45, 46 and 47. Further, the wash fluid tube 48 is inserted through the intermediate holding member 49 in an axis center position.

Here, description will be made of a case of assembling the feed tube 41 according to the fourth embodiment. In this case, the paint tubes 44, 45, 46 and 47 are respectively connected to the tube joints 42E, 42F and the like of the connecting member 42, and the wash fluid tube 48 is connected to the wash fluid supplying port 42G. On the other hand, the intermediate holding member 49 is inserted in the tube through hole 43A of the tube body 43, and is arranged in the depth (front end side) of the tube through hole 43A. In this state, the respective paint tubes 44, 45, 46 and 47, and the wash fluid tube 48 are inserted in the tube through hole 43A of the tube body 43, while the connecting member 42 is mounted to a base end side of the tube body 43.

At this time, the paint tubes 44, 45, 46 and 47 are respectively inserted through the respective holding holes 49A, 49B and the like of the intermediate holding member 49, and the tube positioning holes 43B1, 43B2, 43B3 and 43B4 of the positioning member 43B, and the front ends 44C, 45C, 46C and 47C are made to project from the respective tube positioning holes 43B1, 43B2, 43B3 and 43B4. On the other hand, the wash fluid tube 48 is inserted through the intermediate holding member 49 and the positioning member 43B in the axis center position. Thereby, the feed tube 41 that is provided with the four paint tubes 44, 45, 46 and 47, and the single wash fluid tube 48 can be assembled.

Description will be made of a case of performing a coating by using the feed tube 41. In this case, one paint is selected from paints set to the paint tubes 44, 45, 46 and 47 each, which is supplied. As a result, for example, this paint can be ejected from the paint tube 44 toward the rotary atomizing head 7 through the first paint supplying port 42C of the connecting member 42, and it is possible to spray this paint from the rotary atomizing head 7.

In this way, also in the fourth embodiment as thus configured, the operational effect substantially similar to that of the first embodiment described before can be obtained. Particularly, according to the fourth embodiment, there are provided the four paint tubes 44, 45, 46 and 47 that eject the paint, wherein the front ends 44C, 45C, 46C and 47C of the respective paint tubes 44, 45, 46 and 47 extend to the rotary atomizing head 7. Therefore, the wash work at color changing can be simplified to improve the coating efficiency.

It should be noted that in the first embodiment, an explanation thereof is made by taking a case where the tube joints 12F and 12G are provided in the connecting member 12, and the paint tubes 18A and 18B are mounted to the outer peripheral side of the tube joints 12F and 12G, as an example. However, the present invention is not limited thereto, and may be configured such that a hole portion is formed in a connecting member, and a paint tube is inserted and fitted in the hole portion. This configuration can be applied to the other embodiments.

In the first embodiment, the tube body 15 and the positioning member 16 are provided to be separated from each other, and the fixing tubular body 17 is used to mount the positioning member 16 to the front end 15C of the tube body 15. On the other hand, in the second embodiment, the positioning member 26B is provided to be integral with the front end of the tube body 26. The present invention is not limited to each of these embodiments, and the tube body 15 and the positioning member 16 according to the first embodiment may be integrally provided. On the other hand, the positioning member 26B according to the second embodiment may be provided separately from the tube body 26 to be mounted separately therefrom. This configuration can similarly be applied to the third and fourth embodiments.

In the first embodiment, an explanation thereof is made by taking a case where the intermediate holding member 13 that holds the halfway section of each of the paint tubes 18A and 18B is provided in the tube body 15, as an example, and in the fourth embodiment, an explanation thereof is made by taking a case where the intermediate holding member 49 is provided in the tube body 43, as an example. This intermediate holding member may be provided in each of the second and third embodiments.

In the first embodiment, an explanation thereof is made by taking a case where the three projecting portions 16C are provided in each of the tube positioning holes 16A and 16B constituting the positioning member 16, as an example. However, the present invention is not limited thereto, and the present invention may be configured such that two, four or more projecting portions 16C are provided in each of the tube positioning holes 16A and 16B. This configuration may be applied to the other embodiments.

In the first embodiment, an explanation thereof is made by taking a case where the connecting member 12 and the intermediate holding member 13 are connected by using the wash fluid tube 14 comprising the tubular body having the wash fluid passage 14A therein, and thereby the wash fluid is caused to flow in the wash fluid passage 14A in the wash fluid tube 14. However, the present invention is not limited thereto, and, for example, the connecting member 12 and the intermediate holding member 13 may be connected by using a bar-shaped body not provided with a wash fluid passage therein. In this case, a tube provided therein with the wash fluid passage, which is separated from the bar-shaped body, may be used to cause the wash fluid to flow.

In the third embodiment, an explanation thereof is made by taking a case where the circular wash fluid supplying port 34 is provided between the connecting member 32 and the mounting portion 33B of the tube body 33, as an example. However, the present invention is not limited thereto, and, for example, the wash fluid supplying port may be provided to the connecting member 32 to be separated from the paint supplying port 32A.

In the fourth embodiment, there is exemplified a case of providing the four paint tubes 44, 45, 46 and 47 that eject the paint. However, the present invention is not limited thereto, and three, five or more paint tubes may be provided.

In the first embodiment, an explanation thereof is made by taking a case where the paint is supplied to the respective paint tubes 18A and 18B of the feed tube 11 from the paint supplying source through the respective paint supplying passages 10A and 10B of the housing 2, as an example. However, the present invention is not limited thereto, and the present invention may be configured, for example, such that a feed tube is provided as a part of a cartridge that accommodates the paint therein, and the paint is supplied from the cartridge to a paint tube of the feed tube. This configuration may similarly be applied to the other embodiments.

In each of the embodiments, an explanation thereof is made by taking a case of providing the high voltage generator 9 that applies a high voltage directly to the solvent paint, as an example. However, the present invention is not limited thereto, and the present invention may be applied to an electrostatic coating machine of an indirect charging type for applying a high voltage to paint particles sprayed from a rotary atomizing head by an external electrode, for example. The present invention can further be applied to a non-electrostatic coating machine that performs coating without applying a high voltage. In this non-electrostatic coating machine, a housing and the like can be formed by using a metallic material.

DESCRIPTION OF REFERENCE NUMERALS

1: Rotary atomizing head type coating machine
5: Air motor (Motor)
6: Rotational shaft
7: Rotary atomizing head
11, 21, 31, 41: Feed tube
12, 22, 32, 42: Connecting member
12C, 23C, 42C: First paint supplying port
12D, 23D, 42D: Second paint supplying port
12E, 34, 42G: Wash fluid supplying port
13, 49: Intermediate holding member
14, 48: Wash fluid tube
14A, 29, 36, 48A: Wash fluid passage
15, 26, 33, 43: Tube body
15A, 26A, 33A, 43A: Tube through hole
16, 26B, 33C, 43B: Positioning member
16A, 16B, 26B1, 33C1, 43B1, 43B2, 43B3, 43B4: Tube positioning hole
16C, 26B2, 33C2: Projecting portion
16D, 26C, 33D, 48B: Wash fluid ejecting port
16E: Concave curved surface portion
18A, 18B, 35, 44, 45, 46, 47: Paint tube
18A1, 18B1, 35A, 44A, 45A, 46A, 47A: Paint passage
18A2, 18B2, 27B, 28B, 35B, 44B, 45B, 46B, 47B: Base end
18A3, 18B3, 27C, 28C, 35C, 44C, 45C, 46C, 47C: Front end
23: Base section
24: Coupling section
27: Inner tube (Paint tube)
27A: Main agent passage (Paint passage)
28: Outer tube (Paint tube)
28A: Curing agent passage (Paint passage)
32A: Paint supplying port

The invention claimed is:

1. A rotary atomizing head type coating machine comprising:

a motor of an air-driven type;

a hollow rotational shaft that is rotatably supported by the motor and including a front end that projects forward from the motor;

a rotary atomizing head mounted in the front end of the rotational shaft and that sprays paint supplied thereto while rotating together with the rotational shaft; and a feed tube that extends through an inside of the rotational shaft from a rear side of the motor to the rotary atomizing head for supplying the paint to the rotary atomizing head;

wherein the feed tube comprises:

a connecting member provided in the rear side of the motor and including one or plural paint supplying ports connected to a paint supplying source;

an elongated tube body formed of a hollow tubular body, and including a base end connected to the connecting member and a front end extended in the rotational shaft toward the rotary atomizing head;

a positioning member provided in the front end of the tube body and including at least one tube positioning hole axially penetrating therein; and one or plural resin paint tubes provided to axially extend in the tube body, and including a base end connected to the paint supplying port of the connecting member and a front end inserted through the tube positioning hole of the positioning member, and wherein the paint tube is formed as a tubular body in an inside of which a paint passage is formed by using a resin material having elasticity and water repellency, wherein the at least one tube positioning hole of the positioning member includes a plurality of projecting portions that are elongated in the direction of the longitudinal axis of the tube positioning hole and project radially inward of the tube positioning hole such that radially inwardmost parts of the projecting portions contact with an outer peripheral surface of the paint tube and support the paint tube, and wherein said projecting portions form gaps between an inner peripheral surface of said tube positioning hole and said outer peripheral surface of said paint tube, the gaps being elongated in the direction of the axis of the tube positioning hole.

2. The rotary atomizing head type coating machine according to claim 1, wherein, the connecting member includes a wash fluid supplying port that is connected to a wash fluid supplying source to be separated from the paint supplying port, the positioning member includes a wash fluid ejecting port that ejects wash fluid toward the rotary atomizing head, and the tube body includes a wash fluid passage through which the wash fluid flows between the wash fluid supplying port and the wash fluid ejecting port.

3. The rotary atomizing head type coating machine according to claim 2, wherein, the wash fluid passage is formed as a wash fluid tube that axially extends in the tube body and establishes connection between the wash fluid supplying port and the wash fluid ejecting port.

4. The rotary atomizing head type coating machine according to claim 2, wherein, the wash fluid passage is a flow space that is formed between an inner peripheral surface of the tube body and the paint tube, and in which the wash fluid flows.

5. The rotary atomizing head type coating machine according to claim 2, wherein the gaps are used as the wash fluid ejecting ports.

6. The rotary atomizing head type coating machine according to claim 1, wherein, the positioning member includes a concave curved surface portion in a concave curved shape that is formed in a front end position facing the rotary atomizing head, and the tube positioning hole is opened to the concave curved surface portion.

7. The rotary atomizing head type coating machine according to claim 1, wherein, the tube body includes an intermediate holding member that holds a halfway section of the paint tube in a length direction.

8. The rotary atomizing head type coating machine according to claim 7, wherein, the tube body includes a wash fluid tube, an axially extended base end side connected to the connecting member, and a front end side connected to the intermediate holding member, and the wash fluid tube includes a wash fluid passage in which the wash fluid supplied from a wash fluid supplying source flows.

9. The rotary atomizing head type coating machine according to claim 1, further comprising a plurality of tube joints connected to said paint supplying ports, wherein outer peripheries of said tube joints each exhibit a plurality of stepped sections.

* * * * *